US008737879B2

(12) United States Patent
Ito et al.

(10) Patent No.: US 8,737,879 B2
(45) Date of Patent: May 27, 2014

(54) OPENING AND CLOSING MECHANISM AND IMAGE FORMING APPARATUS INCLUDING THE OPENING AND CLOSING MECHANISM

(75) Inventors: Yoichi Ito, Tokyo (JP); Akiyoshi Tanaka, Kanagawa (JP); Kuniyori Takano, Kanagawa (JP); Yuuji Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 253 days.

(21) Appl. No.: 13/312,066

(22) Filed: Dec. 6, 2011

(65) Prior Publication Data

US 2012/0155916 A1 Jun. 21, 2012

(30) Foreign Application Priority Data

Dec. 15, 2010 (JP) ..... 2010-279841

(51) Int. Cl.
*G03G 21/00* (2006.01)

(52) U.S. Cl.
USPC ..... 399/124

(58) Field of Classification Search
USPC ..... 399/110, 124, 125; 312/325, 327, 328; 16/233; 49/148
See application file for complete search history.

(56) References Cited

U.S. PATENT DOCUMENTS

| | | | | |
|---|---|---|---|---|
| 6,678,490 | B2 | 1/2004 | Tanaka | |
| 7,469,981 | B2 | 12/2008 | Katsuyama et al. | |
| 2009/0074457 | A1 * | 3/2009 | Ushiyama | 399/126 |

FOREIGN PATENT DOCUMENTS

| | | |
|---|---|---|
| JP | 9-26736 | 1/1997 |
| JP | 2000-38870 | 2/2000 |
| JP | 2003-255649 | 9/2003 |
| JP | 2003-345220 | 12/2003 |
| JP | 2005-111979 | 4/2005 |
| JP | 2005-195701 | 7/2005 |

* cited by examiner

*Primary Examiner* — David Gray
*Assistant Examiner* — Gregory H Curran
(74) *Attorney, Agent, or Firm* — Cooper & Dunham LLP

(57) ABSTRACT

An opening and closing mechanism includes a movable member removably mounted relative to a main body of an apparatus, an opening and closing member having a cover portion, protrusions, and pivot shafts, and shaft position adjusters to change positions of the pivot shafts while the cover portion pivots between a closed position and an open position. The opening and closing member is arranged so that, on an imaginary plane perpendicular to a central axis of each pivot shaft on which each pivot shaft and the movable member are projected, a projected portion of each pivot shaft is positioned to interfere with a projected portion of the movable member when the cover portion is placed at the closed position, and the cover portion is positioned so as not to interfere with a trajectory of movement of the movable member while the cover portion pivots toward the open position.

17 Claims, 20 Drawing Sheets

OPENING AND CLOSING MECHANISM AND IMAGE FORMING APPARATUS INCLUDING THE OPENING AND CLOSING MECHANISM

CROSS-REFERENCE TO RELATED APPLICATIONS

This patent application is based on and claims priority pursuant to 35 U.S.C. §119 to Japanese Patent Application No. 2010-279841, filed on Dec. 15, 2010, in the Japan Patent Office, the entire disclosure of which is hereby incorporated by reference herein.

TECHNICAL FIELD

This disclosure relates to an opening and closing mechanism and an image forming apparatus including the opening and closing mechanism, and more specifically to an opening and closing mechanism to open and close an opening and closing member, and an image forming apparatus, such as a copier, a printer, a facsimile machine, a plotter, and a printing apparatus, including the opening and closing mechanism.

DESCRIPTION OF THE BACKGROUND ART

Image forming apparatuses are used as printers, facsimile machines, copiers, plotters, or multi-functional devices having two or more of the foregoing capabilities. As a conventional type of image forming apparatus, an image forming apparatus is known that has a cover member, such as a front cover, openable and closable in a pivoting manner at a front side of an apparatus main body to enable an operator to perform maintenance and replacement of components within the apparatus main body from the front side of the apparatus main body, that is, so-called front-side operation. As another conventional type of image forming apparatus, an image forming apparatus is known that has an opening and closing mechanism including an opening and closing member. The opening and closing mechanism includes a movable member, such as a sheet feed tray, removably insertable relative to the apparatus main body and a cover member serving as the opening and closing member, such as a cover, openable and closable in a pivoting manner around a pivot shaft between a closed position at which the cover member covers the interior of the apparatus main body and an open position at which the cover member opens the interior of the apparatus main body to the exterior.

However, no conventional arts (including the above-described conventional arts) are found to propose to deal with the following challenges. Specifically, in the above-described opening and closing mechanism having the movable member, such as a sheet feed tray, and the cover member serving as the opening and closing member, such as a cover, and the image forming apparatus including the opening and closing mechanism, for example, the cover member is located at an upper portion of the apparatus main body and the movable member is located adjacent to and below the cover member. In such a configuration, unless the pivot shaft is disposed higher than the movable member, a portion of the cover member (e.g., a bottom portion) interferes with the movable member when the movable member is removed from the apparatus main body. Meanwhile, unless the pivot shaft of the cover member is located lower than a position at which the cover member might interfere with the movable member, a member may interfere with the cover member in a part of the pivoting range in which the cover member starts to open from the closed position. In such a case, unless the position of the pivot shaft is changed in the vertically upward direction, the cover member may interfere with the movable member. To deal with such a challenge, simply, the clearance between the cover member and the movable member might be increase to prevent the interference of the cover member with the movable member. However, such a configuration may increase the size of the apparatus increases and degrade the appearance of the apparatus.

BRIEF SUMMARY

In an aspect of this disclosure, there is provided an improved opening and closing mechanism including a movable member, an opening and closing member, and shaft position adjusters. The movable member is removably mounted relative to a main body of an apparatus. The opening and closing member has a cover portion, protrusions, and pivot shafts. The cover portion is pivotable between a closed position and an open position around the pivot shafts. The cover portion covers an interior of the main body at the closed position and opens the interior of the main body to an outside of the main body at the open position. The protrusions protrude outward from positions of the cover portion adjacent to the pivot shafts. The shaft position adjusters change positions of the pivot shafts while the cover portion pivots between the closed position and the open position. The opening and closing member is arranged relative to the main body so that, on an imaginary plane perpendicular to a central axis of each of the pivot shafts on which each of the pivot shafts and the movable member are projected, a projected portion of each of the pivot shafts is positioned to interfere with a projected portion of the movable member when the cover portion is placed at the closed position, and the cover portion is positioned so as not to interfere with a trajectory of movement of the movable member relative to the main body while the cover portion pivots toward the open position.

In another aspect of this disclosure, there is provided an improved image forming apparatus including a main body, an image forming device, and the opening and closing mechanism described above.

In still another aspect of this disclosure, there is provided an improved opening and closing mechanism including movable means, opening and closing means, and position adjustment means. The movable means is removably mounted relative to a main body of an apparatus. The opening and closing means opens an interior of the main body relative to an outside of the main body at an open position and closes the interior of the main body relative to the outside of the main body at a closed position. The opening and closing means has cover means for covering the interior of the main body and pivoting means for pivoting the cover means. The position adjustment means changes positions of the pivoting means while the cover means pivots between the closed position and the open position so that, on an imaginary plane perpendicular to a central axis of each of the pivoting means on which each of the pivoting means and the movable means are projected, a projected portion of each of the pivoting means interferes with a projected portion of the movable means when the cover means is placed at the closed position, and the cover means does not interfere with a trajectory of movement of the movable means while the cover means pivots toward the open position.

In yet still another aspect of this disclosure, there is provided an improved image forming apparatus including a main body, an image forming device, and the opening and closing mechanism described above.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
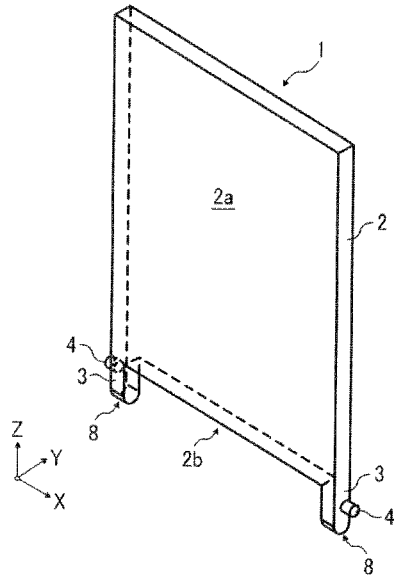
FIG. 1 is a perspective view of a cover member of an opening and closing mechanism according to a first exemplary embodiment of the present disclosure.

The accompanying drawings are intended to depict exemplary embodiments of the present disclosure and should not be interpreted to limit the scope thereof The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below. In exemplary embodiments, the same reference characters are allocated to elements (members or components) having the same function and shape and redundant descriptions thereof are omitted below. For sake of simplicity and clearness, elements considered to require no specific descriptions may be omitted from drawings.

First Exemplary Embodiment

A first exemplary embodiment of the present disclosure is described with reference to FIGS. 1 to 7.

FIG. 1 is a perspective view of a cover member of an opening and closing mechanism according to the first exemplary embodiment of the present disclosure.

Figure 2:
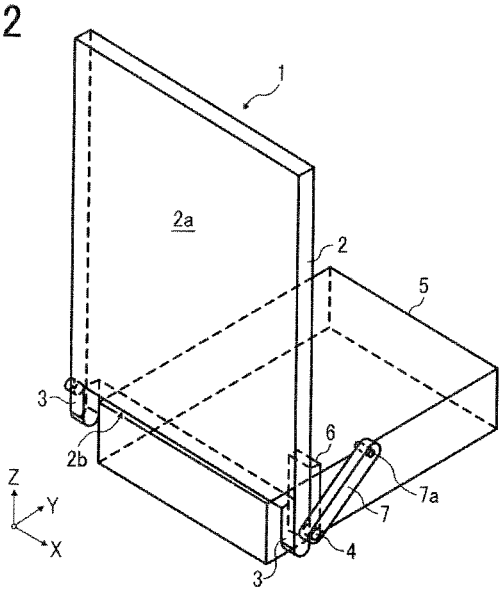
FIG. 2 is a perspective view of the opening and closing mechanism of FIG. 1 in a state in which the cover member is placed at a closed position and a movable member is placed at a mount position.

FIG. 2 is a perspective view of the opening and closing mechanism in a state in which a cover portion of the cover member (hereinafter, may be simply referred to as cover member) is placed at a closed portion and a movable member is placed at a mount position.

Figure 3:
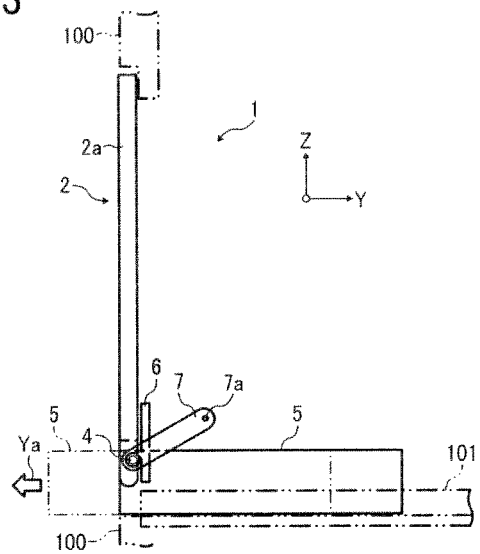
FIG. 3 is a front view of the opening and closing mechanism of FIG. 1 in a state in which the cover member is placed at the closed position and the movable member is placed at the mount position and a position on a trajectory of movement.
Figure 4:
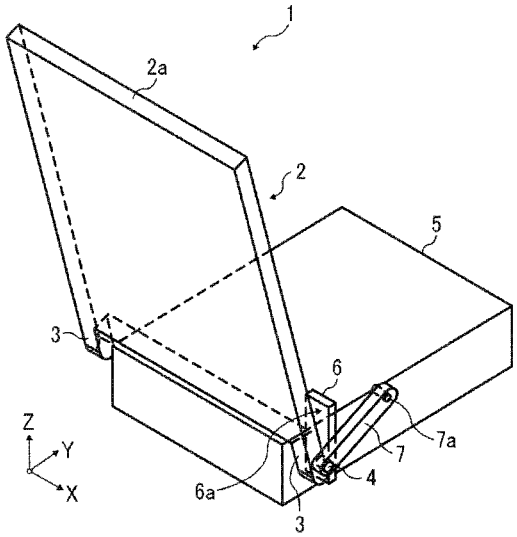
FIG. 4 is a perspective view of the opening and closing mechanism of FIG. 1 in a state in which the cover member is slightly open and the movable member is placed at the mount position.
Figure 5:
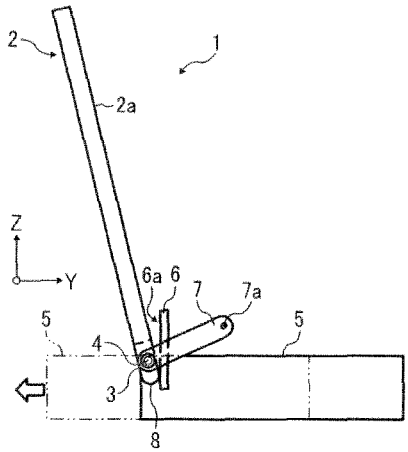
FIG. 5 is a front view of the opening and closing mechanism of FIG. 1 in a state in which the cover member is slightly open and the movable member is placed at the mount position and a position on the trajectory of movement.
Figure 6:
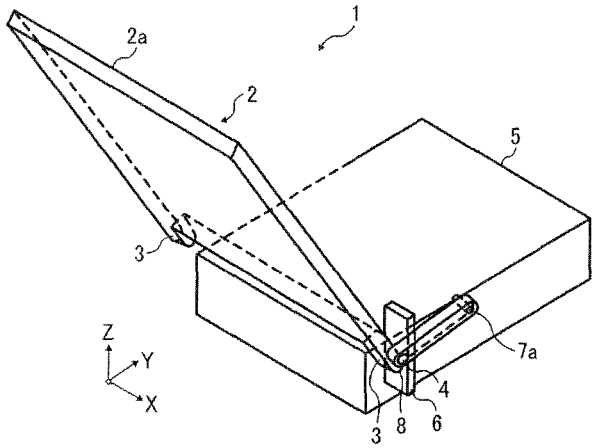
FIG. 6 is a perspective view of the opening and closing mechanism of FIG. 1 in a state in which the cover member is placed at an open position and the movable member is placed at the mount position.
Figure 7:
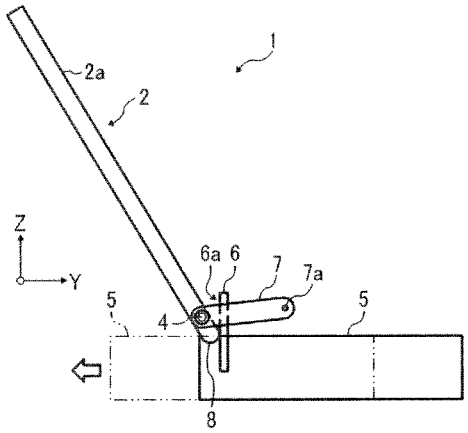
FIG. 7 is a front view of the opening and closing device of FIG. 1 in a state in which the cover member is placed at the open position and the movable member is placed at the mount position and a position on the trajectory of movement.

FIG. 3 is a front view of the opening and closing mechanism in a state in which the cover member is placed at the closed position and the movable member is placed at the mount position and a position on a trajectory of movement. FIG. 4 is a perspective view of the opening and closing mechanism in a state in which the cover member is slightly open and the movable member is placed at the mount position. FIG. 5 is a front view of the opening and closing mechanism in a state in which the cover member is slightly open and the movable member is placed at the mount position and a position on the trajectory of movement. FIG. 6 is a perspective view of the opening and closing mechanism in a state in which the cover member is placed at the open position and the movable member is placed at the mount position. FIG. 7 is a front view of the opening and closing mechanism in a state in which the cover member is placed at the open position and the movable member is placed at the mount position and a position on the trajectory of movement.

In FIG. 1, the reference characters X, Y, Z represent three axes of a three-dimensional coordinate system, and the reference character 1 represents the opening and closing mechanism according to this exemplary embodiment. The opening and closing mechanism 1 has a movable member 5, pivot shafts 4, a cover member 2, and shaft position adjusters. The movable member 5 serving as movable means is removably insertable relative to the apparatus main body 100 (indicated by a chain double-dashed line in FIG. 3) in an insertion-and-removal direction Y (parallel to the Y axis in FIG. 3). The cover member 2 serving as an opening and closing member or means has a cover portion 2*a* and protrusions 3. The cover portion 2*a* serving as cover means is openable and closable relative to the apparatus main body 100 and pivots around the pivot shafts 4 serving as pivoting means between a closed position (illustrated in FIGS. 2 and 3) at which the cover portion 2*a* covers the interior of the apparatus main body 100 and an open position (illustrated in FIGS. 6 and 7) at which the cover portion 2*a* opens the interior of the apparatus main body 100 to the exterior of the apparatus main body 100. The protrusions 3 protrude from portions of the cover portion 2*a* adjacent to the respective pivot shafts 4 downward in the vertical direction (i.e., in a direction parallel to the Z axis in FIG. 2). The shaft position adjusters serving as position adjustment means change the positions of the corresponding pivot shafts 4 while the cover portion 2*a* pivots between the closed position and the open position. In this exemplary embodiment and the following exemplary embodiment, the direction in which each shaft position adjuster changes the position of the pivot shaft 4 is uniformly described as a vertically upward direction (i.e., a direction perpendicular to the insertion-and-removal direction Y of the movable member 5).

The movable member 5 is, for example, a sheet feed tray or a sheet feed cassette having a substantially box shape (e.g., a rectangular parallelepiped shown in a simplified manner in FIG. 2) and is made of, for example, resin, metal, or a combination of such materials. The mount position of the movable member 5 is a position at which the movable member 5 is set to and held by a certain portion inside the apparatus main body 100 as indicated by, e.g., a solid line in FIG. 3. In FIGS. 3, 5, and 7, the movable member 5 indicated by an alternate long and short dash line represents a trajectory of movement of the movable member 5 in a removal (withdrawal) direction Ya in which the movable member 5 is removed from the apparatus main body 100. As a mechanism for inserting and removing the movable member 5 to and from the apparatus main body 100 in the insertion-and-removal direction Y, for example, a movable-member guide unit 101 (serving as movable-member guide means) including, e.g., a rail member of a recessed shape may be disposed adjacent to and below the movable member 5 to guide the movable member 5 in the insertion-and-removal direction Y so that the movable member 5 is inserted to and removed from the apparatus main body 100. In such a case, for example, a slide mechanism is employed in which lower edge portions at opposed ends of the movable member 5 in the X-axis direction are guided so as to slide over the rail member of the movable-member guide unit 101. The movable member 5 may be inserted to and removed from the apparatus main body 100 by a user's action (pushing and pulling). Alternatively, the movable member 5 may be automatically inserted to and removed from the apparatus main body 100 by a driving device (serving as driving means), e.g., a motor. In drawings described with respect to the following exemplary embodiments, the apparatus main body 100 indicated by the chain double-dashed line in FIG. 3 may be omitted for simplicity.

The cover member 2 includes the pivot shafts 4, the cover portion 2*a* serving as a main part of the cover member 2 (a main part of the opening and closing member), and the protrusions 3 and is made of resin, metal, or a combination of the foregoing materials. The pivot shafts 4 and the protrusions 3 are preferably formed as a single member with the cover member 2 in terms of manufacturing, metal molding, and cost. Alternatively, the pivot shafts 4 and the protrusions 3 may be formed as separate members from the cover member 2 and combined with the cover member 2. As illustrated in FIG. 1, the protrusions 3 and the pivot shafts 4 are disposed at opposed ends in a width direction of the movable member 5 (X-axis direction). In other drawings, one or more of the protrusions 3 and the pivot shafts 4 may be omitted for simplicity.

A holding member serving as holding means, such as an engaging clip or clamp, magnet catcher, or MAGICTAPE (registered trademark) is disposed at the cover portion 2*a* to hold the cover portion 2*a* at the closed position at when the cover portion 2*a* is placed at the closed position. Alternatively, a locking member (serving as locking means) may be disposed to lock the cover portion 2*a* at the closed position. A stopper is also disposed at the cover portion 2*a* to hold the cover portion 2*a* at the open position when the cover portion 2*a* is placed at the open position.

As illustrated in FIGS. 1 and 2, the cover member 2 has a recessed portion 2*b* at a lower end of the cover portion 2*a* to avoid interference with an upper face of the movable member 5. A clearance between the recessed portion 2*b* of the cover portion 2*a* and the upper face of the movable member 5 is set so as to prevent interference between the cover portion 2*a* and the upper face of the movable member 5 within a whole pivoting range of the cover portion 2*a* and a whole insertion and removal range of the movable member 5 and obtain a desired appearance of the apparatus. The outer surface of a lower end of each of the protrusions 3 has a round shape as an outer surface of a partial circular cylinder and serves as a guided portion 8 (guided means) contacted and slidingly guided by a guide member 6 (serving as guide means). Because the guided portion 8 is contacted and slidingly guided by the guide member 6, the guided portion 8 is preferably made of a material(s) of high abrasion resistance and high lubricity. For example, the guided portion 8 may be made of resin, such as polyacetal resin or polyamide resin. Much the same applies to the guide member 6.

As illustrated in FIGS. 2 to 7, each of the shaft position adjusters in this exemplary embodiment includes the guide member 6 to guide the guided portion 8 of the protrusion 3 and an arm 7 (serving as connecting means) having one end pivotably connected to the pivot shaft 4 and the opposite end pivotably connected to an immovable member within the interior of the apparatus main body 100 via an arm shaft 7*a*. In FIGS. 2 to 7, the shaft position adjuster including the guide member 6 and the arm 7 is illustrated at only one side in the X-axis direction (right side or front side in FIGS. 2 to 7) for simplicity. However, another shaft position adjuster is also disposed at the opposite side in the X-axis direction (left side or rear side in FIGS. 2 to 7) to change the position of the pivot shaft 4 upward in the vertical direction (Z-axis direction) in a stable manner. The same applies to exemplary embodiments and drawings described below.

In this exemplary embodiment, the guide members 6 are disposed and fixed at the apparatus main body 100. Alternatively, another configuration may be employed as described below.

Additionally, in this exemplary embodiment, the shaft position adjuster has a double hinge mechanism (the arm 7 and the guide member 6). Alternatively, another configuration may be employed as described below.

In addition to the above-described configuration, the opening and closing mechanism 1 has the following configuration.

The cover member 2 is arranged and formed so that, when the pivot shafts 4 and the movable member 5 are projected from a central axis direction (X-axis direction) of each pivot shaft 4 onto a Y-Z plane perpendicular to the central axis of each pivot shaft 4 in FIGS. 2 and 3, a projected portion of each pivot shaft 4 is positioned to interfere with a projected portion of the movable member 5 when the cover portion 2*a* is placed at the closed position. Meanwhile, as illustrated in FIGS. 6 and 7, the cover portion 2*a* is positioned so as not to interfere with a trajectory of movement of the movable member 5 when the cover portion 2*a* pivots toward the open position. In this regard, the Y-Z plane is also a plane having the pivot shaft 4 as a normal line.

Next, operation of the opening and closing mechanism 1 is described with reference to FIGS. 2 to 7.

The configuration illustrated in FIGS. 2 to 7 assumes that a user grips an upper portion of the cover portion 2*a* to open the cover member 2. When the cover portion 2*a* is opened from the closed position illustrated in FIGS. 2 and 3, as illustrated in FIGS. 4 and 5, the cover portion 2*a* pivots counterclockwise around the pivot shafts 4. At this time, by the principle of leverage, an operating force of the user acting on the upper portion of the cover portion 2*a* (force applied point) is converted into a moment acting on the guided portions 8 of the protrusions 3 via the pivot shafts 4 serving as fulcrums. Additionally, the guided portions 8 of the protrusions 3 are disposed lower than the respective pivot shafts 4 and the positions of the arm shafts 7*a* of the arms 7 are fixed. As a result, each guided portion 8 is constantly pressed against a vertical guide face 6*a* of the corresponding guide member 6 by the above-described moment. As the cover portion 2*a* pivots to the open position, each of the guided portions 8 of the protrusions 3 is guided upward in the vertical direction by slidingly contacting the vertical guide face 6*a* of the guide member 6. As a result, the pivot shaft 4 substantially integrated with the corresponding protrusion 3 moves upward in the vertical direction and the cover portion 2*a* is placed at the open position illustrated in FIGS. 6 and 7.

In FIGS. 2 and 3, when the pivot shafts 4 and the movable member 5 are projected from the central axis direction (X-axis direction) of each pivot shaft 4 onto the Y-Z plane perpendicular to the central axis of each pivot shaft 4, the cover portion 2*a* pivots to open and close without interfering with the movable member 5 although a projected portion of each pivot shaft 4 projected on the Y-Z plane is placed at the position to interfere with a projected portion of the movable member 5 projected on the Y-Z plane.

By contrast, as illustrated in FIGS. 4 to 7, when the cover portion 2*a* pivots toward the open position, each of the guided portions 8 of the protrusions 3 is guided by the vertical guide face 6*a* of the guide member 6 while slidingly contacting the vertical guide face 6*a*, and each pivot shaft 4 slides upward in the vertical direction (hereinafter, hop-up movement). Thus, the cover portion 2*a* is positioned so as not to interfere with the trajectory of operation and movement of the movable member 5.

Pivoting operation of the cover portion 2*a* from the open position to the closed position is performed in the reverse order with the above-described order. In other words, when the cover portion 2*a* pivots toward the closed position, each of the guided portions 8 of the protrusions 3 is guided by the vertical guide face 6*a* of the guide member 6 while slidingly contacting the vertical guide face 6*a*, and the pivot shaft 4 moves downward in the vertical direction (hereinafter, hop-up movement). Thus, the cover portion 2*a* is placed at the closed position.

In the following exemplary embodiments, the pivoting operation of the cover portion 2*a* from the above-described to the closed position is performed in substantially the same manner as this first exemplary embodiment, and therefore descriptions thereof are omitted unless particularly necessary.

In this exemplary embodiment, the shaft position adjuster (e.g., the double hinge mechanism including the arm 7 and the guide member 6) adjusts the position of the pivot shaft 4 of the cover member 2. As a result, even in a case in which an internal member or component within the apparatus main body 100 may otherwise interfere with the cover portion 2*a* during opening and closing operation of the cover portion 2*a*, interference of the cover portion 2*a* with such an internal member and the movable member 5 can be prevented without increasing the size of the apparatus main body 100. In a case in which the double hinge mechanism including the arm 7 and the guide member 6 is employed as the shaft position adjuster, the position of the pivot shaft 4 can be adjusted with a simple configuration of members or components. Additionally, fixing the guide member 6 at the apparatus main body 100 prevents the guide member 6 from applying load against the insertion and removal operation of the movable member 5, thus preventing a reduction in operability. Furthermore, because the guide portion (the vertical guide face 6*a*) of the guide member 6 is stable, clearances between the guide member 6 and internal components are easy to control.

Second Exemplary Embodiment

A second exemplary embodiment of the present disclosure is described below with reference to FIGS. 8 to 12.

Figure 8:
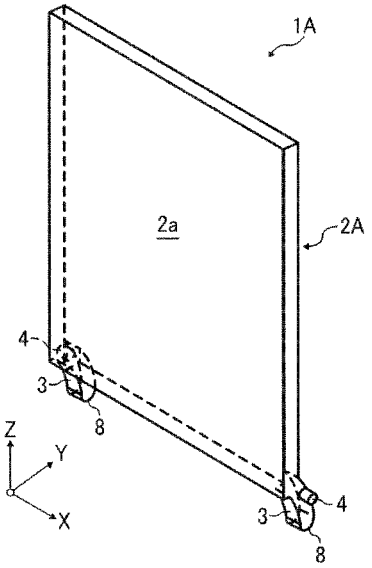
FIG. 8 is a perspective view of a cover member of an opening and closing mechanism according to a second exemplary embodiment.
Figure 9:
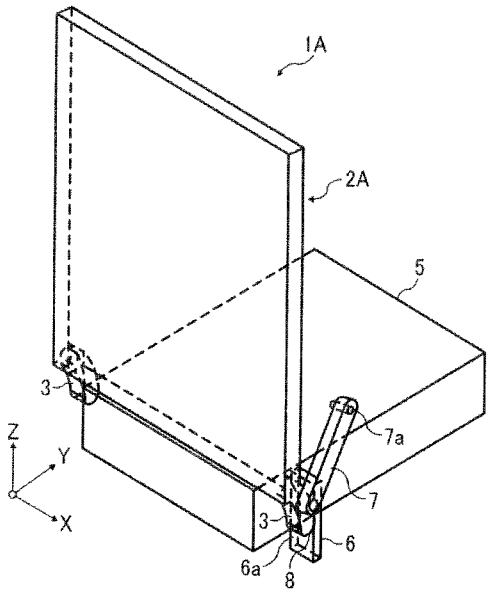
FIG. 9 is a perspective view of the opening and closing mechanism of FIG. 8 in a state in which the cover member is placed at a closed position and the movable member is placed at a mount position.
Figure 10:
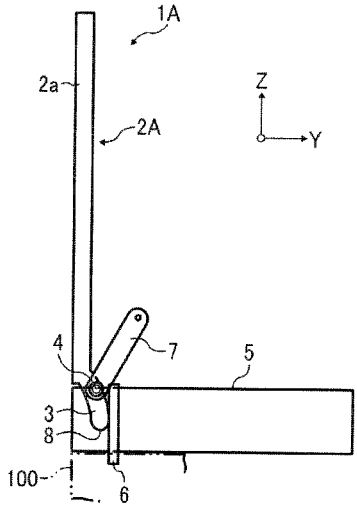
FIG. 10 is a front view of the opening and closing mechanism of FIG. 8 in a state in which the cover member is placed at the closed position and the movable member is placed at the mount position.
Figure 11:
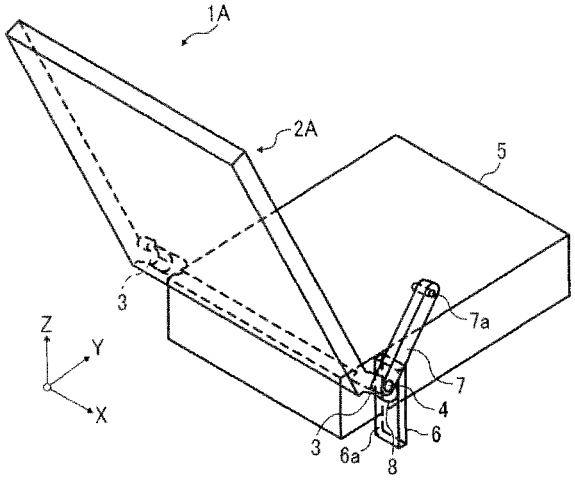
FIG. 11 is a perspective view of the opening and closing mechanism of FIG. 8 in a state in which the cover member is placed at an open position and the movable member is placed at the mount position.
Figure 12:
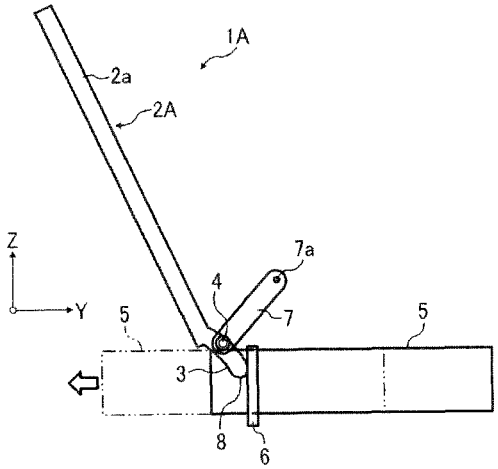
FIG. 12 is a front view of the opening and closing mechanism of FIG. 8 in a state in which the cover member is placed at the open position and the movable member is placed at the mount position and a position on the trajectory of movement.

FIG. 8 is a perspective view of a cover member of an opening and closing mechanism according to the second exemplary embodiment. FIG. 9 is a perspective view of the opening and closing mechanism in a state in which the cover member is placed at a closed position and the movable member is placed at a mount position. FIG. 10 is a front view of the opening and closing mechanism in a state in which the cover member is placed at the closed position and the movable member is placed at the mount position. FIG. 11 is a perspective view of the opening and closing mechanism in a state in which the cover member is placed at the open position and the movable member is placed at the mount position. FIG. 12 is a front view of the opening and closing mechanism in a state in which the cover member is placed at the open position and the movable member is placed at the mount position and a position on the trajectory of movement.

As illustrated in FIGS. 8 to 12, an opening and closing mechanism 1A according to the second exemplary embodiment differs from the opening and closing mechanism 1 according to the first exemplary embodiment. In particular, the opening and closing mechanism 1A according to the second exemplary embodiment differs from the opening and closing mechanism 1 illustrated in FIGS. 1 to 7 in that the opening and closing mechanism 1A employs a cover member 2A serving as an opening and closing member or means instead of the cover member 2 of the opening and closing mechanism 1.

As illustrated in FIGS. 8 to 12, the cover member 2A differs from the cover member 2 of the first exemplary embodiment in that protrusions 3 of the cover member 2A are placed more inward of the apparatus main body 100 relative to an outer face of the apparatus main body 100 illustrated in FIG. 10 which the cover portion 2*a* forms part of at the closed position, over an entire range of a pivoting trajectory of a cover portion 2*a* during opening and closing operation. In other words, when the cover portion 2*a* is placed at the closed position, the protrusions 3 (or the cover portion 2*a*) guided by the guide member 6 are placed inward of the apparatus main body 100 so as to overlap a movable member 5 in a distance longer than pivot shafts 4. Such a difference also exists between the first exemplary embodiment and each of third and fourth exemplary embodiments described with reference to FIGS. 13 to 16. Except for the above-described difference, the configuration and operation of the second exemplary embodiment are substantially the same as those of the first exemplary embodiment.

Next, with reference to FIGS. 8 to 12, operation of the opening and closing mechanism 1A is described mainly with respect to the difference from the opening and closing mechanism 1 of the first exemplary embodiment.

When the cover portion 2*a* is pivotingly opened from the closed position illustrated in FIGS. 9 and 10, as illustrated in FIGS. 11 and 12, the cover portion 2*a* pivots counterclockwise around the pivot shafts 4. Through the same operation as the above-described first exemplary embodiment, each of guided portions 8 of the protrusions 3 are constantly pressed against a vertical guide face 6*a* of the guide member 6. In this time, a portion opposite the cover portion 2*a* with respect to the pivot shafts 4 disposed at the protrusions 3, that is, the guided portion 8 illustrated in FIGS. 9 to 12 is bent toward the interior of the apparatus main body 100. As a result, the guided portion 8 illustrated in FIGS. 9 to 12 moves further more inward of the apparatus main body 100 than the above-described first exemplary embodiment. Subsequent operations are performed in substantially the same manner as the first exemplary embodiment.

In FIGS. 9 and 10, when the pivot shafts 4 and the movable member 5 are projected from the central axis direction (X-axis direction) of the pivot shaft 4 onto the Y-Z plane perpendicular to the central axis of the pivot shaft 4, the cover portion 2*a* can pivot for opening and closing operation without interfering with the movable member 5 although the projected portion of the pivot shaft 4 is placed at the position to interfere with the projected portion of the movable member 5. By contrast, as illustrated in FIGS. 11 and 12, when the cover portion 2*a* pivots toward the open position, the pivot shaft 4 hops up in the same manner as the first exemplary embodiment. As a result, the cover portion 2*a* is placed at the position to not interfere with a trajectory of operation and movement of the movable member 5.

In the second exemplary embodiment, the protrusions 3 of the cover member 2A are placed inward of the apparatus main body 100 relative to an outer face of the apparatus main body 100 which the cover portion 2*a* forms part of at the closed position, over an entire range of a pivoting trajectory of the cover portion 2*a* during opening and closing operation. In other words, the protrusions 3 are not placed outside the apparatus main body 100. Such a configuration obviates formation of, for example, a cut-out portion at an exterior member of the apparatus main body 100 to avoid interference with the protrusions 3, thus preventing degradation in appearance. Additionally, in the hop-up movement of the pivot shaft 4, the guided portion 8 moves further more inward of the apparatus main body 100 than the first exemplary embodiment. As a result, the guide member 6 for hopping up the pivot shaft 4 can be disposed inside the apparatus main body 100 without protruding outward from the apparatus main body 100, thus facilitating downsizing of the apparatus. From another viewpoint, when the cover portion 2*a* is placed at the closed position, the protrusions 3 guided by the guide member 6 are placed inward of the apparatus main body 100 so as to overlap the movable member 5 in a distance longer than the pivot shaft 4. As a result, the guided portion 8 of the protrusions 3 are placed further inward of the apparatus main body 100, thus not affecting the size of the apparatus main body 100. Additionally, such a configuration facilitates the guide member 6 to be held by a structural body of the apparatus main body 100 and to be formed as a single member with the structural body of the apparatus main body 100, which is advantageous in cost, size, and strength.

Like the first exemplary embodiment, the cover member 2A of the second exemplary embodiment does not interfere with the trajectory of movement of the movable member 5 during opening and closing operation of the cover portion 2*a*. The movable member 5 can be withdrawn or removable from the apparatus main body 100 regardless of whether the cover portion 2*a* is performing opening or closing operation or which position the cover portion 2*a* is placed at. The use of the double hinge mechanism including the arm 7 and the guide member 6 as the shaft position adjuster allows adjustment of the position of the pivot shaft 4 with a simple configuration of members or components. Additionally, because the guided portion 8 guided by the guide member 6 is disposed adjacent to the pivot shaft 4, thus facilitating a reduction in the size of the apparatus main body 100. As described above, the second exemplary embodiment also has effects equivalent to basic effects of the first exemplary embodiment. The same applies to effects of each of the following exemplary embodiments.

For the shaft position adjusters having a simple configuration as described in this second exemplary embodiment or the first exemplary embodiment, the guided portion 8 is placed adjacent to the pivot shaft 4 and guided near the pivot shaft 4 by the guide member 6. As a result, to slidingly move the pivot shaft 4 upward in the vertical direction (Z-axis direction), the direction of force acting on the guide member 6 and the guided portion 8 may depart from the angle at which the pivot shaft 4 moves. Consequently, the frictional force between the guide member 6 and the guided portion 8 might increase, thus hampering smooth opening and closing of the cover portion 2*a* or causing wear and deterioration of the guide member 6 and the guided portion 8. Further, if the guided portion 8 and the cover portion 2*a* are formed as a single member, it might be difficult to select a friction coefficient of the guided portion 8 against the guide member 6 and a material of high wear resistance while considering the balance between requirements for exterior parts, such as cost, flame-resistance, and strength. Additionally, to deal with the above-described concerns (wear and deterioration in operability), if the pivot shaft 4 and the guided portion 8 are disposed away from each other, the layout of the interior of the image forming apparatus may be affected, which might make it difficult to reduce the size of the apparatus main body. Hence, the following third exemplary embodiment is devised.

Third Exemplary Embodiment

A third exemplary embodiment according to the present disclosure is described with reference to FIGS. 13 and 14.

Figure 13:
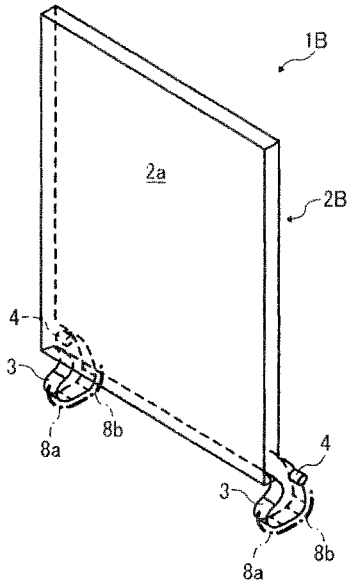
FIG. 13 is a perspective view of a cover member of an opening and closing mechanism according to a third exemplary embodiment.

FIG. 13 is a perspective view of a cover member of an opening and closing mechanism according to the third exemplary embodiment. FIG. 14 is a perspective view of the opening and closing mechanism in a state in which the cover member is placed at a closed position and a movable member is placed at a mount position.

Figure 14:
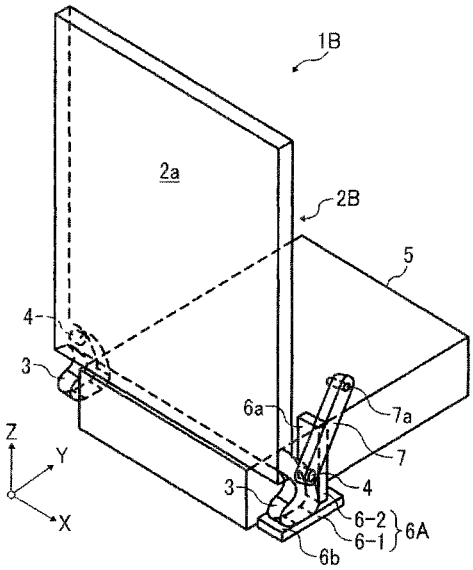
FIG. 14 is a perspective view of the opening and closing mechanism of FIG. 13 in a state in which the cover member is placed at a closed position and a movable member is placed at a mount position.

As illustrated in FIGS. 13 and 14, an opening and closing mechanism 1B according to the third exemplary embodiment differs from the opening and closing mechanism 1A according to the first exemplary embodiment. The opening and closing mechanism 1B differs from the opening and closing mechanism 1A illustrated in FIGS. 8 to 12 mainly in that, as illustrated in FIG. 14, the opening and closing mechanism 1B employs a cover member 2B (serving as an opening and closing member or means) instead of the cover member 2A of the opening and closing mechanism 1A and guide members 6A (serving as guide means) instead of the guide members 6 forming part as the shaft position adjusters.

As illustrated in FIGS. 13 and 14, the cover member 2B differs from the cover member 2A of the second exemplary embodiment in that each of protrusions 3 of the cover member 2B has a plurality of guided portions 8*a* and 8*b* serving as guided means and, with opening and closing operation of the cover portion 2*a* of the cover member 2B, the guided portions 8*a* and 8*b* are guided by the guide member 6A so that the positions of the guided portions 8*a* and 8*b* indicated by alternate long and short dash lines in FIG. 13 are changed.

As illustrated in FIGS. 13 and 14, the guide members 6A differ from the guide members 6 of the second exemplary embodiment in that each of the guide members 6A has a plurality of guide portions 6-1 and 6-2 and, with opening and closing operation of the cover portion 2*a* of the cover member 2B, the positions of the guide portions 6-1 and 6-2 are adjusted to guide the guided portions 8*a* and 8*b*. The guide portions 6-1 has a horizontal guide face 6*b* and the guide portions 6-2 has a vertical guide face 6*a*, and each guide member 6A is formed with plates so as to have a substantially L shape. Except for the above-described differences, the configuration of the third exemplary embodiment is substantially the same as the configuration of the second exemplary embodiment.

Below. operation of the opening and closing mechanism 1B is described mainly with respect to differences from the opening and closing mechanism 1A of the above-described second exemplary embodiment. When the cover portion 2*a* is opened from a closed position illustrated in FIG. 14, the cover portion 2*a* pivots counterclockwise around the pivot shafts 4. At this time, first, the guided portions 8*a* of the protrusions 3 are guided by the horizontal guide face 6*b* of the guide portion 6-1 to slide over the horizontal guide face 6*b*, thus causing the pivot shafts 4 to move upward in the vertical direction. Then, the guided portion 8*b* contacts the vertical guide face 6*a* of the guide portion 6-2 and slides over the vertical guide face 6*a* upward in the vertical direction to hop up the pivot shaft 4.

In the cover member 2B of the third exemplary embodiment, each of the protrusions 3 has the plurality of guided portions 8*a* and 8*b*, and each of the guide members 6A has the plurality of guide portions 6-1 and 6-2. Such a configuration can match a weighted direction of a weighted point (a contact point of the guide member 6A and the guided portion 8*a* or 8*b*) with the movement direction of the pivot shaft 4, that is, the vertically upward direction As a result, as compared with the configurations of the first and second exemplary embodiments, such a configuration can prevent wear and deterioration of operability without increasing the distance between the pivot shaft 4 and the weighted point.

Fourth Exemplary Embodiment

Figure 15:
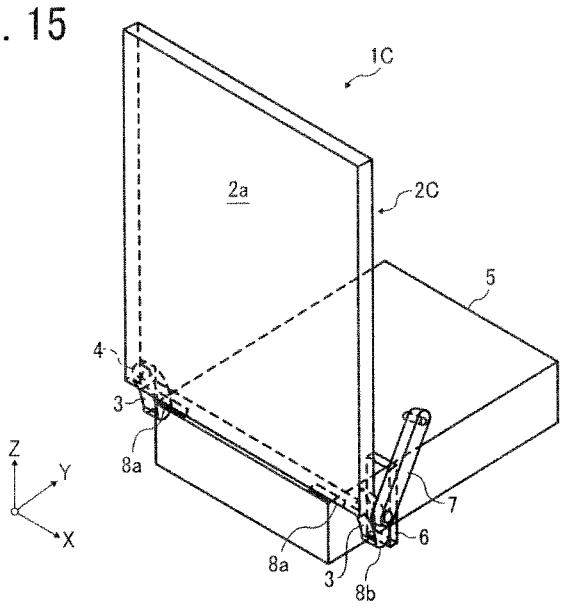
FIG. 15 is a perspective view of an opening and closing mechanism according to a fifth exemplary embodiment in a state in which a cover member is placed at a closed position and a movable member is placed at a mount position.
Figure 16:
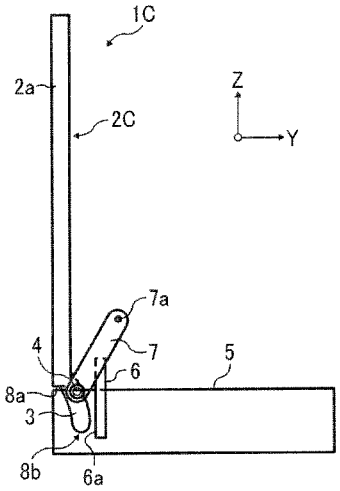
FIG. 16 is a front view of the opening and closing mechanism in the state illustrated in FIG. 15.
Figure 17:
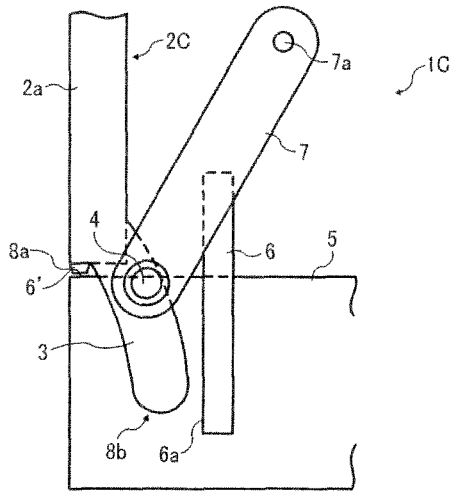
FIG. 17 is a partially enlarged front view of the opening and closing mechanism illustrated in FIG. 16.

A fourth exemplary embodiment of the present disclosure is described below with reference to FIGS. 15 to 17. FIG. 15 is a perspective view of an opening and closing mechanism in a state in which a cover member is placed at a closed position and a movable member is placed at a mount position. FIG. 16 is a front view of the opening and closing mechanism 1C in the state illustrated in FIG. 15. FIG. 17 is a partially enlarged front view of the opening and closing mechanism 1C illustrated in FIG. 16.

As illustrated in FIGS. 15 to 17, an opening and closing mechanism 1C according to the fourth exemplary embodiment differs from the opening and closing mechanism 1B according to the third exemplary embodiment. The opening and closing mechanism 1C according to the fourth exemplary embodiment differs from the opening and closing mechanism 1B of the third exemplary embodiment illustrated in FIGS. 13 and 14 mainly in the following points. That is, as illustrated in FIGS. 15 to 17, in the opening and closing mechanism 1C, a cover member 2C serving as an opening and closing member or means is employed instead of the cover member 2B of the opening and closing mechanism 1B, and guide members 6 forming part of shaft position adjusters similar to those of the first and second exemplary embodiments and second guide members 6' disposed at the movable member 5 are employed instead of the guide members 6A of the opening and closing mechanism 1B.

As illustrated in FIGS. 15 to 17, the cover member 2C differs from the cover member 2B of the third exemplary embodiment in that multiple guided portions 8*a* (two in this fourth exemplary embodiment) are disposed at lateral edges of a bottom of the cover portion 2*a* and protrusions 3 each having a single guided portion 8 (referred to as guided portion 8*b* in this fourth exemplary embodiment) similar to that of the second exemplary embodiment illustrated in, e.g., FIG. 8 are integrally formed with the cover portion 2*a* at a position adjacent to a pivot shaft 4. As illustrated in FIG. 17, the second guide members 6' are disposed on lateral edges (both edges in the Y-axis direction in FIG. 15) of an upper face of the movable member 5 at an end proximal to the cover portion 2*a* in the Y-axis direction (left end in FIG. 17) to guide the guided portions 8*a* at the lateral edges of the bottom of the cover portion 2*a*.

As described above, in the fourth exemplary embodiment, the second guide members 6', one of a plurality of types of guide members, are disposed at the movable member 5 to guide the cover portion 2*a*, and the guide members 6, the other of the plurality of types of guide members, are disposed at the apparatus main body.

Next. operation of the opening and closing mechanism 1C is described mainly with respect to differences from the opening and closing mechanism 1B of the above-described third exemplary embodiment.

When the cover portion 2*a* is opened from a closed position illustrated in FIGS. 15 to 17, the cover portion 2*a* pivots counterclockwise around the pivot shafts 4. At this time, first, the guided portions 8*a* of the cover portion 2*a* are guided by the guide members 6' of the movable member 5 while contacting the guide members 6', thus causing the pivot shafts 4 to move upward in the vertical direction, that is, hop up. Then, the guided portions 8*b* of the protrusions 3 contact the guide members 6 to further hop up the pivot shafts 4.

In addition to the effects of the above-described third exemplary embodiment, the opening and closing mechanism according to the fourth exemplary embodiment has effects equivalent to the following effects. The fourth exemplary embodiment differs from the third exemplary embodiment in that the second guide members 6', one of the plurality of types of guide members, are disposed at the movable member 5 and the guide members 6' guide the cover portion 2*a*. However, the fourth exemplary embodiment are expected to have effects equivalent to the third exemplary embodiment, and the fourth exemplary embodiment provides more freedom of selection in layout or positioning of components from which clearance is to be maintained. In the fourth exemplary embodiment illustrated in FIGS. 15 to 17, the above-described differences from the third exemplary embodiment are simultaneously employed. Such a configuration can reliably maintain the clearance from a target component (e.g., the movable member 5 in this exemplary embodiment) at high precision. In the fourth exemplary embodiment, interference of the cover portion 2*a* with the movable member 5 is to be regulated. Hence, the guide members 6' and the guided portions 8*a* are disposed at the target components, thus reliably preventing the cover portion 2*a* from interfering with the movable member 5 with s minimum clearance.

Fifth Exemplary Embodiment

A fifth exemplary embodiment of the present disclosure is described below with reference to FIG. 18.

Figure 18:
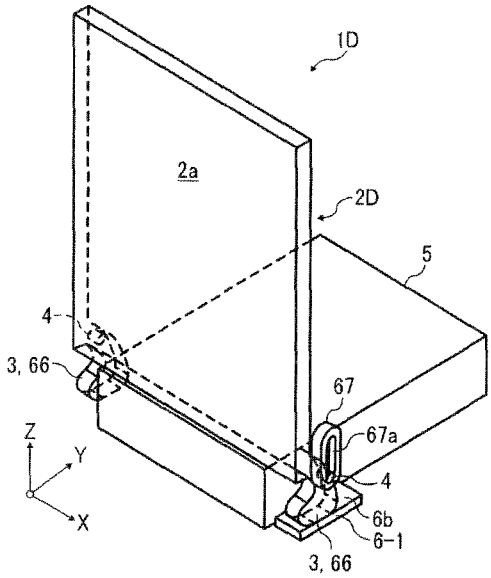
FIG. 18 is a perspective view of an opening and closing mechanism according to a fifth exemplary embodiment in a state in which a cover member is placed at a closed position and a movable member is placed at a mount position.

FIG. 18 is a perspective view of an opening and closing mechanism according to the fifth exemplary embodiment in a state in which a cover member is placed at a closed position and a movable member is placed at a mount position. As illustrated in FIG. 18, an opening and closing mechanism 1D according to the fifth exemplary embodiment differs from the opening and closing mechanism 1B illustrated in FIG. 14 according to the third exemplary embodiment. The opening and closing mechanism 1D differs from the opening and closing mechanism 1B illustrated in FIG. 14 mainly in that, as illustrated in FIG. 18, the opening and closing mechanism 1D employs a cover member 2D serving as an opening and closing member or means instead of the cover member 2B of the opening and closing mechanism 1B, omits the arm 7 of the third exemplary embodiment, and employs slide holders 67 and guide portions 6-1 to guide protrusions 3 instead of the guide members 6A forming part as the shaft position adjusters.

As illustrated in FIG. 18, the cover member 2D differs from the cover member 2B of the third exemplary embodiment in that each of the protrusions 3 has a cam portion 66 to apply force in a direction to change the position of the pivot shaft 4 instead of the multiple guided portions 8*a* and 8*b*. The guide portions 6-1 are fixed at the apparatus main body 100 to guide the respective cam portions 66 in slide contact with the cam portions 66. Each of the slide holders 67 is fixed at the apparatus main body 100 to hold the corresponding pivot shaft 4 while sliding the pivot shaft 4 in the direction to change the position of the pivot shaft 4. Each slide holder 67 has slide slits 67*a* to guide the pivot shaft 4 in the vertical direction while loosely fitting the pivot shaft 4. As described above, in the fifth exemplary embodiment, each of the shaft position adjusters includes the cam portion 66, the guide portion 6-1, and the slide holder 67.

Next, operation of the opening and closing mechanism 1D is described mainly with respect to differences from the opening and closing mechanism 1B of the above-described third exemplary embodiment.

As the cover portion 2*a* is pivotingly opened from a closed position illustrated in FIG. 18, each cam portion 66 slidingly contacts a horizontal guide face 6*b* of the guide portion 6-1 to hop up the pivot shaft 4. At this time, the pivot shaft 4, while loosely fitting the slide slits 67*a*, can relatively freely moves along the slide slits 67*a* of the slide holder 67. As a result, there is more room in design for the trajectory of movement of the pivot shafts 4 than the connecting manner using the arm 7 as illustrated in FIGS. 2 to 17. Therefore, it is possible to achieve a more favorable design with respect to wear of the horizontal guide faces 6*b* of the guide portions 6-1 and the size of the apparatus main body.

In this exemplary embodiment, a long movement distance of the pivot shaft 4 in the vertically upward direction can be obtained within a range smaller than the shaft position adjuster using the arm 7. If the pivot shaft 4 is moved over a long distance with the arm-type shaft position adjuster, the arm 7 would be relatively long. Additionally, in this fifth exemplary embodiment, more freedom is obtained for the design of the trajectory of movement of the pivot shaft 4, and the operating direction of the cam portion 66 can be more properly balanced with the force direction, thus minimizing wear of the cam portion 66 and the guide portion 6-1 and enhancing ease of operation of the cover portion 2*a*.

Sixth Exemplary Embodiment

Figure 19:
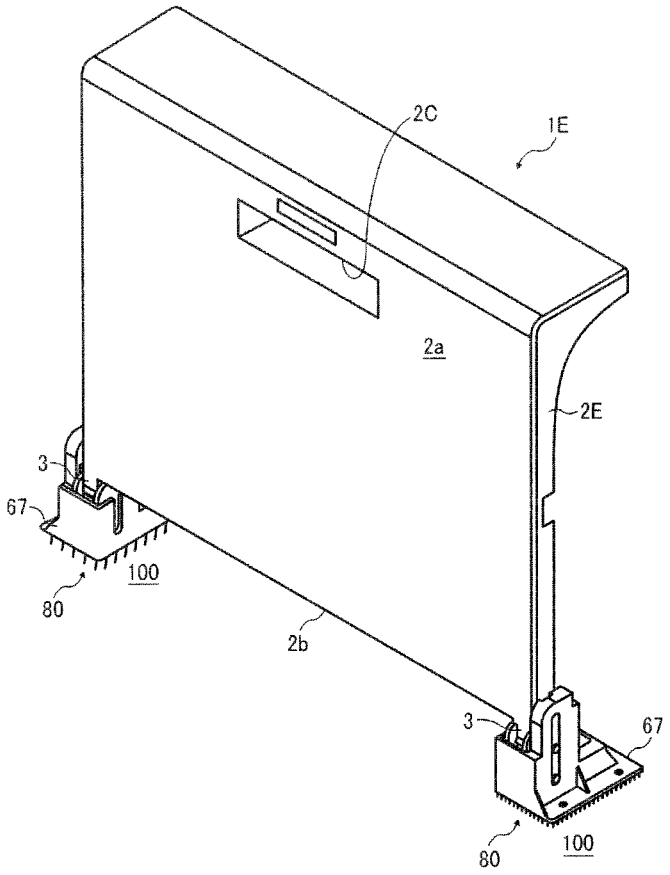
FIG. 19 is a perspective view of an opening and closing device according to a sixth exemplary embodiment in a state in which a cover member is placed at a closed position and a movable member is placed at a mount position.
Figure 20:
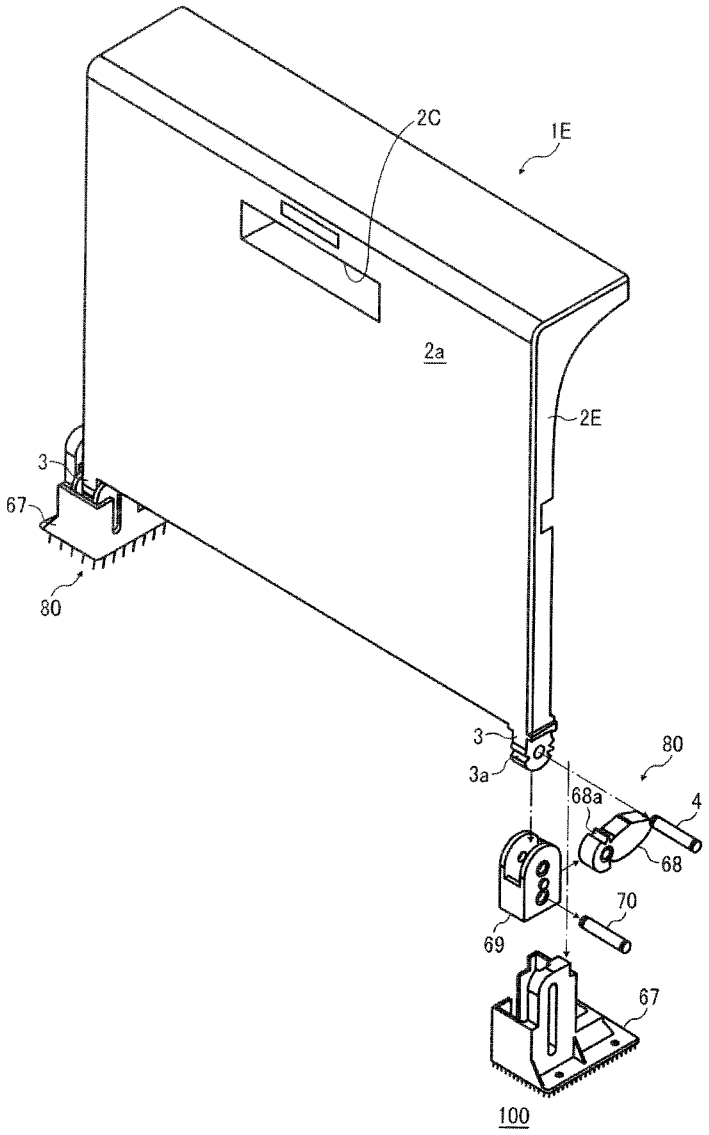
FIG. 20 is an exploded perspective view of a cover member and a hop-up mechanism of the opening and closing mechanism of FIG. 19.
Figure 21:
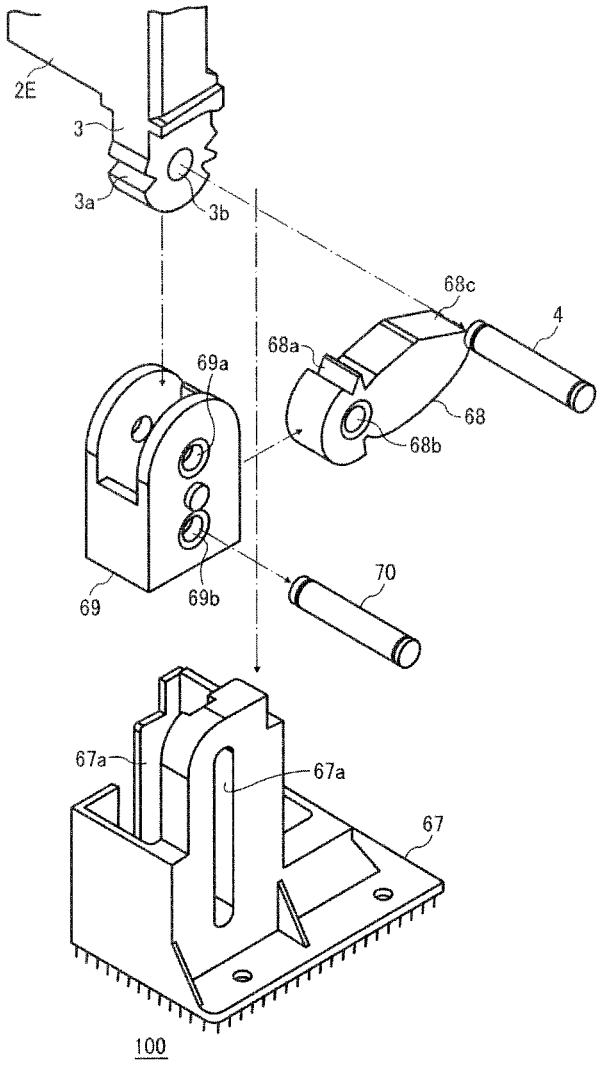
FIG. 21 is an enlarged, exploded perspective view of the hop-up mechanism of FIG. 20.
Figure 22:
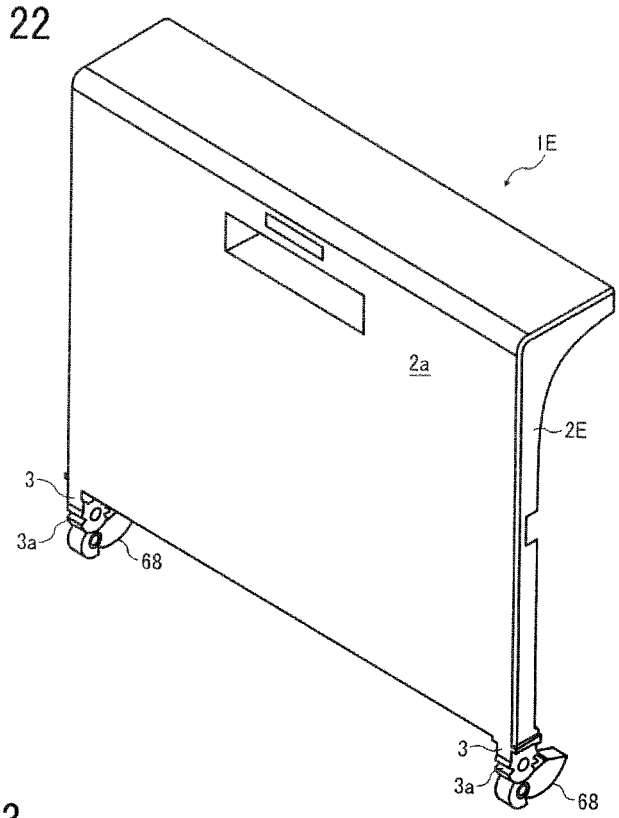
FIG. 22 is a perspective view of the cover member and an interior of the hop-up mechanism of the opening and closing mechanism of FIG. 19 in a state in which the cover member is placed at the closed position.
Figure 23:
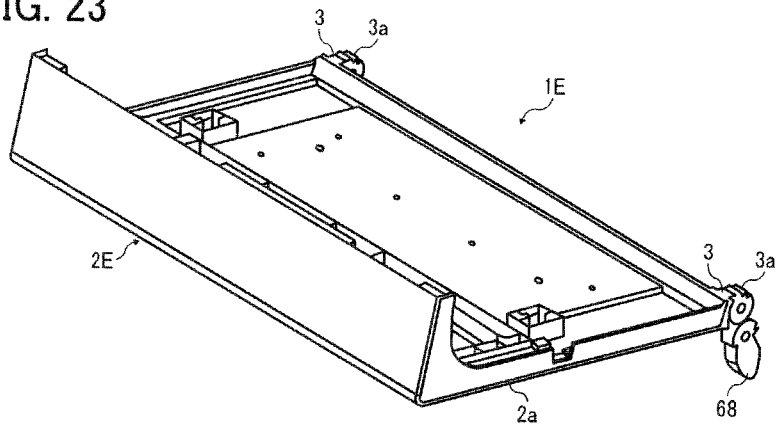
FIG. 23 is a perspective view of the cover member and the interior of the hop-up mechanism of the opening and closing mechanism of FIG. 22 in a state in which the cover member is placed at the open position.
Figure 24A:
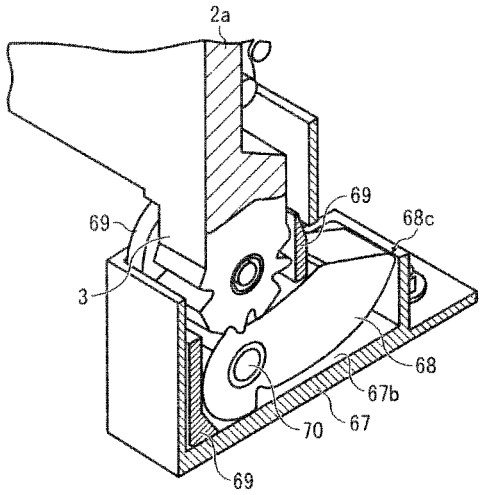
FIG. 24A is a partially cross-sectional perspective view of the hop-up mechanism when the cover member is placed at the closed position.
Figure 24B:
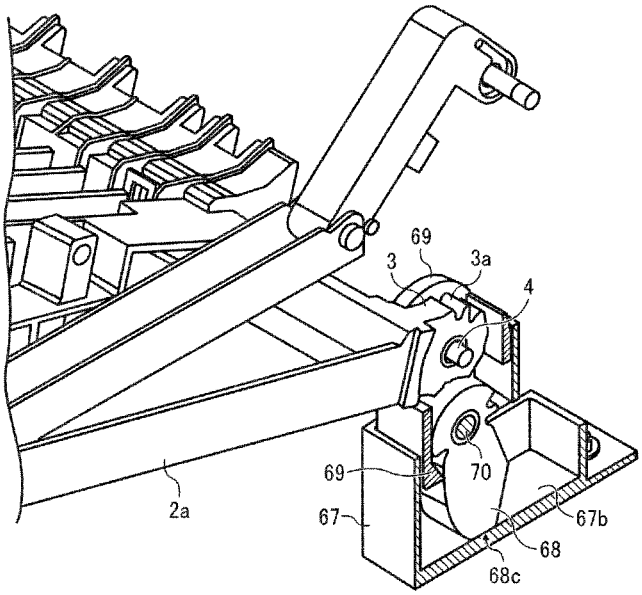
FIG. 24B is a partially cross-sectional perspective view of the hop-up mechanism when the cover member is placed at the open position.
Figure 25B:
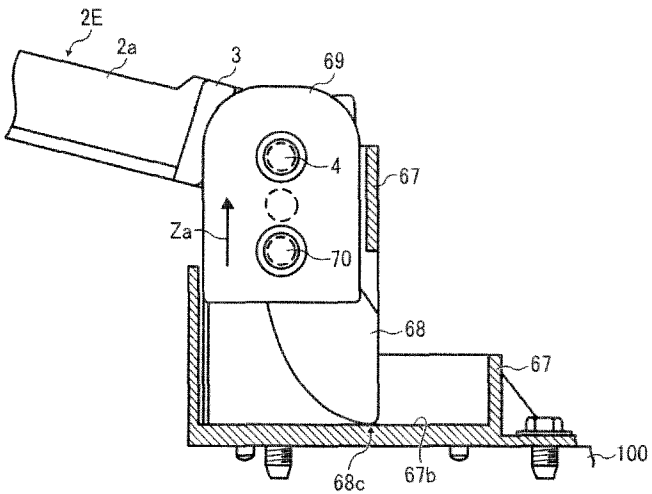
FIG. 25B is a partially cross-sectional front view of the hop-up mechanism when the cover member is placed at the open position.
Figure 25A:
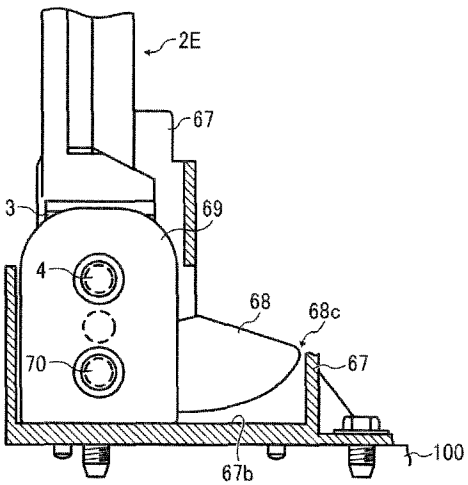
FIG. 25A is a partially cross-sectional front view of the hop-up mechanism when the cover member is placed at the closed position.

A sixth exemplary embodiment of the present disclosure is described with reference to FIGS. 19 to 25. In FIGS. 19 to 25, a movable member of an opening and closing mechanism is omitted for simplicity. FIG. 19 is a perspective view of an opening and closing mechanism in a state in which a cover member is placed at a closed position. FIG. 20 is an exploded perspective view of the opening and closing mechanism of FIG. 19. FIG. 21 is a partially-enlarged exploded view of the opening and closing mechanism of FIG. 19. FIGS. 22 and 23 are perspective views of the cover member placed at the closed position and an open position, respectively. FIGS. 24A and 24B are partially-cross-sectional perspective views of the cover member placed at the closed position and the open position, respectively. FIGS. 25A and 25B are partially-cross-sectional front views of the cover member placed at the closed position and the open position, respectively.

An opening and closing mechanism 1E according to the sixth exemplary embodiment encompasses technical aspects of the first to fifth exemplary embodiments and the configuration in which the opening and closing mechanism 1E is employed in an image forming apparatus is described below in exemplary embodiments. The sixth exemplary embodiment of the present disclosure is described below with reference to FIGS. 19 to 21. As illustrated in FIGS. 19 to 21, an opening and closing mechanism 1E according to the second exemplary embodiment differs from the opening and closing mechanism 1 according to the first exemplary embodiment. The opening and closing mechanism 1E according to the sixth exemplary embodiment differs from the opening and closing mechanism 1 of the first exemplary embodiment mainly in that the opening and closing mechanism 1E employs a cover member 2E serving as an opening and closing member or means instead of the cover member 2 of the opening and closing mechanism 1 and hop-up mechanisms 80 as the shaft position adjusters instead of the arms 7 and the guide members 6. The configuration of the sixth exemplary embodiment is substantially the same as that of the first exemplary embodiment.

As illustrated in FIGS. 19 to 21, the cover member 2E differs from the cover member 2 of the first exemplary embodiment in that the cover member 2E has a grip portion 2*c* which a user grips to open and close the cover member 2E and, instead of the guided portions 8 formed at the tips of the protrusions 3 of the cover portion 2*a*, sector gears 3*a* are formed at the outer circumferences of the bottom ends of the protrusions 3 of the cover portion 2*a*.

The hop-up mechanisms 80 are disposed below the corresponding protrusions 3 at the lateral edges of the bottom end of the cover portion 2*a*. Each of the hop-up mechanisms 80 serving as the shaft position adjusters is coupled to the corresponding protrusion 3 so as to transmit a driving force, and includes a cam 68, a slide shaft 70, a cam holder 69, and a slide holder 67. The cam 68 serving as cam means converts the pivoting movement of the cover portion 2*a* to the movement in a direction to change the position of the pivot shaft 4, that is, the vertically upward direction. The slide shaft 70 serving as slide support means rotatably supports the cam 68. The cam holder 69 serving as cam holding means collectively holds the cam 68 and the pivot shaft 4 via the slide shaft 70. The slide holder 67 serving as slide holding means is fixed at the apparatus main body 100, slides the cam holder 69 in the direction to change the position of the pivot shaft 4, and guides the cam 68 in contact with the cam 68.

The pivot shaft 4 is a separate shaft fitting into an insertion hole 3*b* adjacent to the protrusion 3 and functions in substantially the same manner as the pivot shaft 4 integrally formed as a single member with the cover portion 2*a* in the first exemplary embodiment and so on. In FIG. 21, after the pivot shaft 4 is inserted through an insertion hole 69*a* at an upper portion of the cam holder 69, the pivot shaft 4 is retained with a retaining member, e.g., a retaining ring. Similarly, after the slide shaft 70 is inserted through an insertion hole 69*b* at a lower portion of the cam holder 69, the slide shaft 70 is retained with a retaining member, e.g., a retaining ring. In the configuration of FIGS. 19 to 21, a guide member to guide and move the pivot shaft 4 in contact with the cam 68 is integrally formed with the slide holder 67.

To couple with the protrusion 3 so as to transmit a driving force to the protrusion 3, the cam 68 has a sector gear 68*a* to engage the sector gear 3*a* of the protrusion 3, a shaft hole 68*b* inserted through by the slide shaft 70, and a large-diameter portion 68*c*. The slide holder 67 is mounted and fixed at an immovable member of the apparatus main body 100. The slide holder 67 integrally has a slide guide portion, a horizontal guide face 67*b*, and slide slits 67*a*. The slide guide portion slides the cam holder 69 in the direction to change the position of the pivot shaft 4. The horizontal guide face 67*b* serving as guide means is contacted by the cam 68 to change the position of the slide shaft 70. The slide slits 67*a* guide the cam holder 69 via the slide shaft 70 in a slidable manner. The slide slits 67*a* extend in the vertical direction (Z-axis direction). Opposed ends of each of the pivot shaft 4 and the slide shaft 70 are slidably guided by the slide slits 67*a* formed at lateral sides of the slide holder 67.

The pivot shaft 4 and the slide shaft 70 are made of, for example, steel. Each of the cam 68, the cam holder 69, and the slide holder 67 is integrally molded from proper resin materials of high wear resistance and strength, such as polyacetal resin, polyamide resin, or engineering plastic.

Next, with reference to FIGS. 22 to 25, operation of the opening and closing mechanism 1E is described mainly with respect to the difference from the opening and closing mechanism 1 of the first exemplary embodiment.

When the cover portion 2*a* is placed at a closed position illustrated in FIGS. 22, 24A, and 25A, the bottom face of the cam holder 69 contacts the horizontal guide face 67*b* of the slide holder 67 while the cam 68 is placed above the horizontal guide face 67*b* without contacting the horizontal guide face 67*b*. When the cover portion 2*a* is opened from the closed position, the cover portion 2*a* pivots counterclockwise around the pivot shafts 4. At this time, in FIGS. 24A and 25A, the sector gear 3*a* of the protrusion 3 rotates counterclockwise, and the sector gear 68*a* of the cam 68 engaging the sector gears 3*a* rotates clockwise. As a result, the large-diameter portion 68*c* of the cam 68 contacts the horizontal guide face 67*b*, thus pushing the cam 68 in the vertically upward direction indicated by an arrow Za in FIG. 25B. At this time, the pivot shaft 4 is held together with the cam 68 by the cam holder 69. As a result, the pivot shaft 4 slides in the vertically upward direction indicated by the arrow Za, that is, hops up with the rotation of the cam 68. The trajectory of this sliding movement depends on the shape of the slide holder 67 slidably holding the cam holder 69.

In this sixth exemplary embodiment, the pivoting of the cover portion 2*a* toward the open position is relatively smoothly performed by the hop-up mechanisms 80 with less friction resistance against the hop-up movement of the pivot shaft 4 than any of the above-described first to fifth exemplary embodiments. For example, in the fifth exemplary embodiment illustrated in FIG. 18, the hop-up movement of the pivot shaft 4 is relatively smoothly performed. However, in this sixth exemplary embodiment, it is confirmed with production prototypes that the hop-up movement of the pivot shaft 4 is more smoothly performed than the fifth exemplary embodiment.

Seventh Exemplary Embodiment

A seventh exemplary embodiment according to the present disclosure is described with reference to FIGS. 26 and 27.

Figure 26:
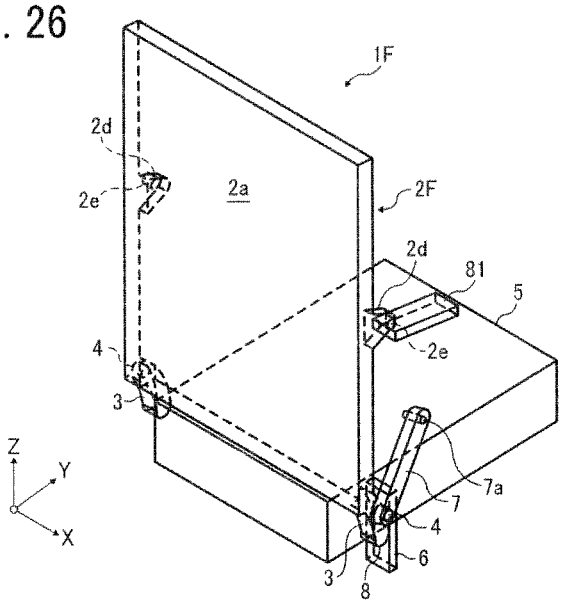
FIG. 26 is a perspective view of an opening and closing mechanism according to a seventh exemplary embodiment in a state in which a cover member is placed at a closed position and a movable member is placed at a mount position.

FIG. 26 is a perspective view of an opening and closing mechanism according to the seventh exemplary embodiment in a state in which a cover member is placed at a closed position and a movable member is placed at a mount position.

Figure 27:
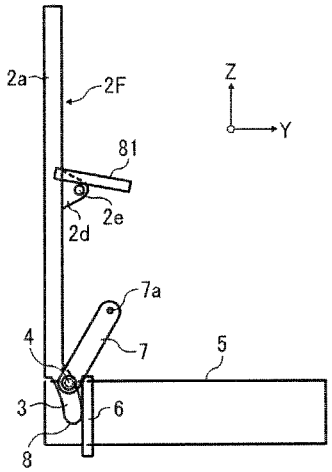
FIG. 27 is a front view of the opening and closing mechanism in the state illustrated in FIG. 26.

FIG. 27 is a front view of the opening and closing mechanism in the state illustrated in FIG. 26. As illustrated in FIGS. 26 and 27, an opening and closing mechanism 1F according to the seventh exemplary embodiment differs from the opening and closing mechanism 1A according to the second exemplary embodiment. The opening and closing mechanism 1F differs from the opening and closing mechanism 1A illustrated in FIGS. 8 to 12 mainly in that, as illustrated in FIGS. 26 and 27, the opening and closing mechanism 1F employs a cover member 2F serving as an opening and closing member or means instead of the cover member 2A of the opening and closing mechanism 1A, and additionally a regulation guide member 81 serving as regulation means is disposed at the apparatus main body to prevent a cover portion 2*a* of the cover member 2F from accidentally moving upward when the cover portion 2*a* is placed at the closed position. The regulation guide member 81 is a plate member fixed at an immovable member of the apparatus main body with an angle slightly tilted upward in the vertical direction from an upstream side to a downstream side in a removal direction of the movable member 5 (from the right side to the left side in the Y-axis direction). In FIG. 26, the regulation guide member 81 is illustrated only at the right front side of the cover member 2F. However, actually, another regulation guide member 81 is similarly disposed at the left rear side of the cover member 2F in FIG. 26.

The cover member 2F differs from the cover member 2A of the second exemplary embodiment illustrated in FIGS. 8 to 12 only in that guided portions 2*d* with guided pins 2*e* to engage the regulation guide members 81 when the cover portion 2*a* of the cover member 2F is placed at the closed position are integrally molded with the cover portion 2*a*. The guided portions 2*d* are integrally molded with the cover portion 2*a* so as to protrude from upper lateral sides of the cover portion 2*a* inward of the apparatus main body when the cover portion 2*a* is placed at the closed position. Each of the guided pins 2*e* is fixed at the corresponding one of the guided portions 2*d* so as to protrude from a lateral side face of the guided portion 2*d* distal to the cover portion 2*a* outward in parallel to the X-axis direction.

Pivoting operation of the cover portion 2*a* from the open position to the closed position is performed in substantially the same manner as the second exemplary embodiment. When the cover portion 2*a* is placed at the closed position, each guided pin 2*e* of the cover portion 2*a* engages a lower tilted face of the regulation guide member 81. As a result, in a state in which accidental upward movement of the cover portion 2*a* of the cover member 2F is regulated, the cover portion 2*a* is engagingly held at the closed position. Such a configuration can enhance the stability of the user's operation for opening the cover portion 2*a* from the closed position and obviate the holding member (holing means) described in the first exemplary embodiment. The configuration of this seventh exemplary embodiment can be employed in any of the above-described first to sixth exemplary embodiments and the following eighth exemplary embodiment.

Eighth Exemplary Embodiment

The eighth exemplary embodiment of the present disclosure is described below with reference to FIGS. 28A and 28B.

Figure 28B:
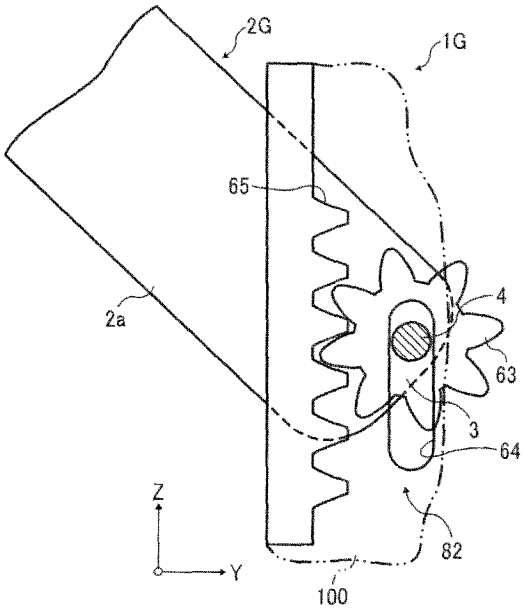
FIG. 28B is an enlarged front view of the opening and closing mechanism in a state in which the cover member is placed at an open position.
Figure 28A:
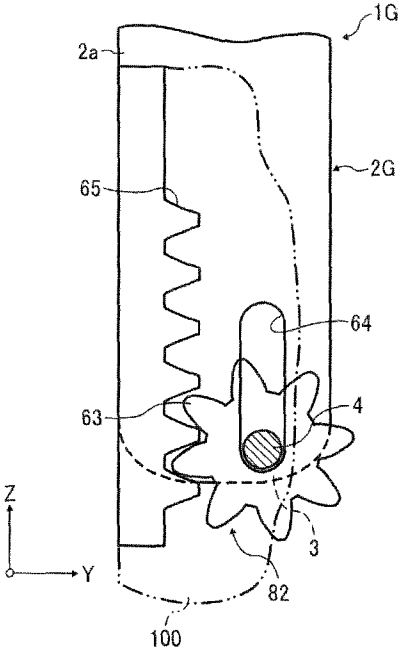
FIG. 28A is an enlarged front view of an opening and closing mechanism according to an eighth exemplary embodiment in a state in which a cover member is placed at a closed position.

FIG. 28A is an enlarged front view of an opening and closing mechanism according to the eighth exemplary embodiment in a state in which a cover member is placed at a closed position. FIG. 28B is an enlarged front view of the opening and closing mechanism in a state in which the cover member is placed at an open position.

As illustrated in FIGS. 28A and 28B, an opening and closing mechanism 1G according to the eighth exemplary embodiment differs from the opening and closing mechanism 1A according to the second exemplary embodiment. The opening and closing mechanism 1G differs from the opening and closing mechanism 1A illustrated in FIGS. 8 to 12 mainly in that, as illustrated in FIGS. 28A and 28B, the opening and closing mechanism 1G employs a cover member 2G serving as an opening and closing member or means instead of the cover member 2A of the opening and closing mechanism 1A and shaft position adjusters 82 serving as position adjustment means instead of the shaft position adjusters including the guide members 6 and the arm 7. Each of the shaft position adjusters 82 includes, e.g., a pinion 63, a shaft guide slit 64, and a rack 65. The shaft position adjusters 82 having the same configuration are disposed at lower lateral sides of the cover member 2G Below, only one of the shaft position adjusters 82 at the front side of FIGS. 28A and 28B is described as a representative.

The cover member 2G differs from the cover member 2A illustrated in FIGS. 8 to 12 in that the pinion 63 is unrotatably fixed at an outer side of a protrusion 3 of the cover member 2G Each of pivot shafts 4 of the cover member 2G is fixed at the pinion 63 in a state in which the pivot shaft 4 passes through a central portion of the pinion 63 and protrudes toward the front side in FIGS. 28A and 28B. At a portion of an apparatus main body 100 adjacent to the protrusion 3 or the pivot shaft 4 (indicated by a chain double-dashed line in FIGS. 28A and 28B) is fixed the rack 65 having teeth along a direction in which the position of the pivot shaft 4 is changed (the vertical direction or X-axis direction) to engage the pinion 63. Additionally, at a portion of the apparatus main body 100 adjacent to the rack 65, the shaft guide slit 64 of an oblong shape is formed to guide the pivot shaft 4 in the direction to change the position of the pivot shaft 4 (the vertical direction or X-axis direction). From the front side toward the rear side in FIGS. 28A and 28B, the rack 65 and the shaft guide slit 64 of the apparatus main body 100, the pinion 63, and the protrusion 3 of the cover member 2G are arranged in this order.

Next, operation of the opening and closing mechanism 1G is described mainly with respect to differences from the opening and closing mechanism 1A of the second exemplary embodiment.

When the cover portion 2*a* is pivotingly opened from the closed position illustrated in FIG. 28A, as illustrated in FIGS. 28A and 28B, with an increase of an opened angle of the cover portion 2*a*, the pinion 63 fixed at the cover portion 2*a* is pressed against the rack 65 and moves upward along the immovable rack 65 while engaging the rack 65. At this time, with the upward movement of the pinion 63 along the rack 65, the pivot shaft 4 is guided along the shaft guide slit 64 to move upward, that is, hop up in parallel to the vertical direction.

As described above, the pivot shaft 4 can also be hopped up by the shaft position adjuster 82 in this eighth exemplary embodiment. In FIGS. 28A and 28B, the pinion 63 engaging the rack 65 has teeth all around the circumference. Alternatively, such teeth of the pinion 63 may be formed only in a range corresponding to a range in which the cover portion 2*a* pivots between the closed position and the open position. The same applies to the range in which the teeth of the rack 65 are formed.

The shapes of the pinion and the rack are not limited to those of this eighth exemplary embodiment but, for example, each of the pinion and the rack may have different teeth shapes (numbers of teeth) corresponding to different engagement portions. For the shaft position adjuster having the cam 68 in the sixth exemplary embodiment illustrated in FIG. 20 and so on, the pivoting speed of the cover member 1E for opening and closing can be freely changed by the outline shape of the cam 68 (cam profile). The shaft position adjuster including the pinion and rack can have substantially the same function. In other words, in a case in which the shaft position adjuster including the pinion and rack has different teeth shapes (numbers of teeth) in different engagement portions, for example, when the cover member starts to open from the closed position, the teeth shapes (numbers of teeth) of the pinion and rack are set to small intervals to reduce the pivoting speed of the cover member. By contrast, when the cover member is further opened toward the open position, the teeth shapes (numbers of teeth) are set to large intervals to increase the pivoting speed. Furthermore, when the cover member is placed at the open position, the teeth shapes (numbers of teeth) are set again to small intervals to reduce the pivoting speed.

Exemplary embodiments are not limited to the above-described first to eighth exemplary embodiments but, for example, the following configuration may be added to the opening and closing mechanism.

At the guide face of each of the guide members 6 illustrated in, e.g., FIG. 6, the guide portions 6-1 and 6-2 illustrated in FIG. 14, the guide portion 6-1 illustrated in FIG. 18 may be disposed a roller serving as a rotary driven member driven in contact with the guided portion 8, 8*a*, or 8*b* of each protrusion 3. Alternatively, by contrast, such a roller serving as a rotary driven member may be disposed at the guided portion 8, 8*a*, or 8*b* of the protrusion 3. Such a roller serving as a rotary driven member can reduce the friction coefficient between the guided portion 8, 8*a*, or 8*b* of the protrusion 3 and the guide face of the guide member 6, 6-1, or 6-2, thus minimizing damage due to wear and enhancing durability.

The protrusion 3 may have a damper mechanism at a movable section thereof Such a damper mechanism of the protrusion 3 can buffer shock occurring when the guided portion 8, 8*a*, or 8*b* of the protrusion 3 contacts the guide face of the guide member 6, 6-1, or 6-2. As a result, the pivoting operation of the cover member for opening and closing can be smoothly performed, thus enhancing the ease of operation of the cover portion 2*a*.

Ninth Exemplary Embodiment

A ninth exemplary embodiment according to the present disclosure is described with reference to FIGS. 29 and 30.

Figure 29:
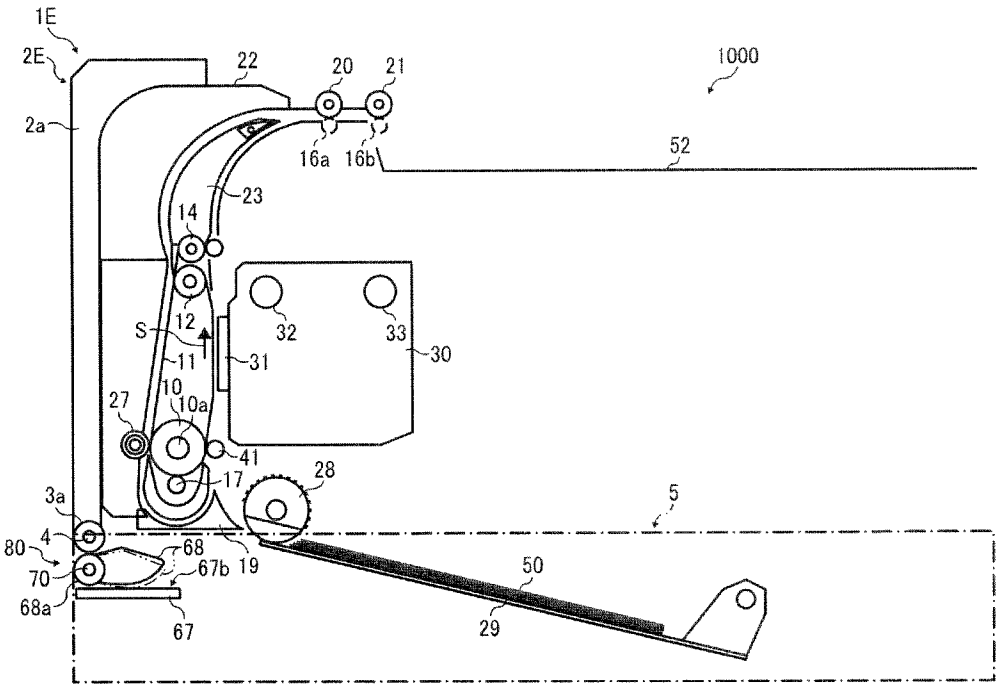
FIG. 29 is a front view of an inkjet recording apparatus of a horizontal ejection type illustrated as an example of an image forming apparatus according to a ninth exemplary embodiment.

FIG. 29 is a front view of an inkjet recording apparatus (hereinafter, inkjet printer) of an electrostatic conveyance type illustrated as an example of an image forming apparatus according to the ninth exemplary embodiment. The inkjet printer is not limited to the electrostatic conveyance type illustrated in FIG. 29 but may be, for example, a platen-rib type using normal conveyance rollers. Below, after the general configuration and operation of the inkjet printer is described, a case is described in which the opening and closing mechanism 1E of the above-described sixth exemplary embodiment is used in the inkjet printer.

In FIG. 29, an inkjet printer 1000 according to the ninth exemplary embodiment is a serial-type inkjet printer. In the inkjet printer 1000, a carriage 30 is supported by two guide rods 32 and 33 so as to slide in a main scanning direction. The guide rods 32 and 33 serving as guide members extend between two, left and right, side plates. The carriage 30 is moved for scanning in the main scan direction by a main scanning motor via a timing belt. The timing belt is looped around a driving pulley and a driven pulley.

On the carriage 30 are mounted, for example, a black recording head 31A (liquid-droplet ejection head) having rows of nozzles (ejection ports) for ejecting ink droplets of black (Bk) and a color recording head 31B (liquid-droplet ejection head) having rows of nozzles for separately ejecting ink droplets of cyan (C), magenta (M), and yellow (Y). The recording heads 31A and 31B (hereinafter, collectively referred to as "recording heads 31" unless colors distinguished) are mounted on the carriage 30 so that rows of nozzles are arranged in parallel to a direction perpendicular to the main scan direction and ink droplets are substantially horizontally ejected from the rows of nozzles.

The inkjet printer 1000 has a sheet feed section that feeds sheets 50 (serving as recording media) stacked on a base plate 29 of a sheet feed tray 5 serving as a sheet storing unit. The sheet feed section includes a sheet feed roller 28 of, e.g., a semilunar shape that separates the sheets 50 from the base plate 29 (sheet stack portion) and feeds the sheets 50 sheet by sheet and a separation pad that is disposed opposing the sheet feed roller 28. The separation pad is made of a material of a high friction coefficient and urged toward the sheet feed roller 28.

The inkjet printer 1000 also has a sheet conveyance section to convey the sheet 50, which is fed from the sheet feed section, with the sheet 50 opposing the recording heads 31. The sheet conveyance section includes a conveyance belt 11 to convey the sheet 50 with the sheet 50 adhered thereon by electrostatic force and a leading-edge press roller 41 urged toward the conveyance belt 11 to guide the sheet 50 onto the conveyance belt 11. The sheet conveyance section also includes a charging roller 17 serving as a charging device to charge the surface of the conveyance belt 11.

The conveyance belt 11 is looped around a conveyance roller 10 serving as a driving roller and a tension roller 12 serving as a driven roller. The conveyance roller 10 is rotated by a sub-scanning motor via a timing belt to circulate the conveyance belt 21 in a belt conveyance direction (sub-scanning direction) indicated by an arrow S in FIG. 29. On the back-face (inner-face) side of the conveyance belt 11 is disposed a sheet guide member at a position corresponding to an image formation area of the recording heads 31.

The charging roller 17 is disposed so as to contact the outer surface of the conveyance belt 11 (e.g., an insulation layer forming the outer surface in a case of a multi-layer belt) and rotate with the circulation of the conveyance belt 11. Pressure is applied to each end of a shaft of the charging roller 17. The conveyance roller 10 has a rotation shaft 10*a* with a slit circular plate. A slit sensor is provided to detect a slit of the slit circular plate. The slit circular plate and the slit sensor form an encoder.

Above the carriage 30 are disposed an encoder scale having slits and an encoder sensor serving as a transmissive photosensor to detect the slits of the encoder scale. The encoder scale and the encoder sensor form an encoder to the position of the carriage 30 in the main scanning direction. The carriage 30 is reciprocally moved with a direct current (DC) motor and a timing belt to form a desired image on the sheet.

The inkjet printer 1000 further includes a sheet output section to output the sheet 50 on which a desired image having been formed by the recording heads 31. The sheet output section has two, first and second, pairs of output rollers of a two-step structure to output sheets and a sheet output tray 52 to stack the sheets output by the two pairs of output rollers. The first pair of rollers is formed of a first output roller 20 and a first spur 16*a* and the second pair of rollers is formed of a second output roller 21 and a second spur 16*b*. In FIGS. 29 and 30, the inkjet printer 1000 also includes an outer duplex guide member 19, an upper output guide member 22, a middle output guide member 23, and a duplex conveyance roller 27.

In the inkjet printer 1000 having the above-described configuration, the sheet 50 is separated sheet by sheet from the sheet feed section, fed in a substantially vertically upward direction, guided by the outer duplex guide member 19, pressed against the conveyance belt 11 by the leading-edge press roller 41, and conveyed by the conveyance belt 11. At this time, positive and negative voltages (outputs) are alternately applied to the charging roller 17 so that positive and negative charges are alternately applied to the conveyance belt 11 at a certain width to form an alternating band pattern of positively-charged areas and negatively-charged areas in the sub-scanning direction in which the conveyance belt 11 circulates. When the sheet 50 is fed onto the conveyance belt 11 alternately charged with positive and negative charges, the sheet 50 is adhered on the conveyance belt 11 and conveyed in the sub scanning direction by the circulation of the conveyance belt 11.

By driving the recording heads 31 in response to image signals while moving the carriage 30 in the main scanning direction, ink droplets are ejected onto the sheet 50, which is stopped below the recording heads 31, to form one line of a desired image. Then, the sheet 50 is fed by a certain distance to prepare for the next operation to record another line of the image. Receiving a recording end signal or a signal indicating that the rear edge of the sheet 50 has arrived at the recording area, the recording heads 31 finish the recording operation and the sheet 50 is output to the sheet output tray 52.

Next, a description is given of a case in which the opening and closing mechanism 1E of the above-described sixth exemplary embodiment is used in the inkjet printer according to this exemplary embodiment.

The inkjet printer 1000 illustrated in FIG. 29 has a configuration to enable a user to perform front-side operation (removal of a jammed sheet or replacement of components from the front side of the apparatus) while minimizing the size of a main body of the inkjet printer (hereinafter referred to as "apparatus main body" or simply "machine").

To minimize the machine size and the number of components while achieving the front-side operation, as illustrated in FIG. 29, the inkjet printer according to this exemplary embodiment has a sheet conveyance path arranged so that, while the carriage 30 mounting the recording heads 31 moves for scanning in the main scanning direction, ink droplets are substantially horizontally ejected from the recording heads 31 to form a desired image on the sheet on the sheet conveyance path. As described above, the inkjet printer according to this exemplary embodiment allows not only access to a sheet feed cassette or a sheet feed tray serving as the movable member 5 (hereinafter referred to as "sheet feed tray 5") from the front side of the apparatus main body but also face-down sheet output to output the sheet with a printed face of the sheet faced down. Such a configuration can achieve a smaller machine size than a conventional S-shaped sheet conveyance path on which ink droplets are ejected downward to form an image on a sheet.

The inkjet printer also has a duplex conveyance path through which the sheet having an image printed on the front face is turned around for image formation on a non-printed back face of the sheet. To allow removal of a jammed sheet from the front side of the apparatus main body and minimize the machine size and the number of components, the duplex conveyance path has a configuration to switch back the sheet 50 separated from a first side of the conveyance belt 11 facing the carriage 30, adhere the sheet 50 onto a second side of the conveyance belt 11 opposite the first side, and convey the sheet 50 with the sheet 50 adhered on the second side of the conveyance belt 11. Additionally, as illustrated in FIG. 30, the inkjet printer employs the above-described hop-up mechanisms 80 to allow the front-side operation, thus enabling the cover portion 2*a* to open and the conveyance belt 11 to pivot around the rotation shaft 10*a* of the conveyance roller 10 for opening and closing.

The charging roller 17 serving as the charging device may be disposed on the upper or lower side of the conveyance belt 11 or on the course of the duplex conveyance path. In this exemplary embodiment, the charging roller 17 is disposed below and adjacent to the conveyance belt 11 at a side close to the recording area (image formation area) in the circulation direction of the conveyance direction 11 in consideration of the risk of user's accidental contact the charging roller applied with high voltage and the charging efficiency of the printed face. Specifically, the reason of the arrangement of the charging roller 17 is as follow.

If the charging roller 17 is disposed at the upper side of the conveyance belt 11, there is a risk that a user might accidentally contact with the charging roller when the conveyance belt 11 is opened to the outside. Additionally, because a second conveyance roller 14 and other member are disposed at the uppers side of the conveyance belt 11, locating the charging roller 17 at the upper side of the conveyance belt 11 would affect the machine size. In addition, because the charging for adhering a print face (image formation face) of the sheet is performed after the conveyance belt 11 goes around, the charging efficiency would decrease. Much the same applies to a case in which the charging roller 17 is disposed on the duplex conveyance path.

Figure 30:
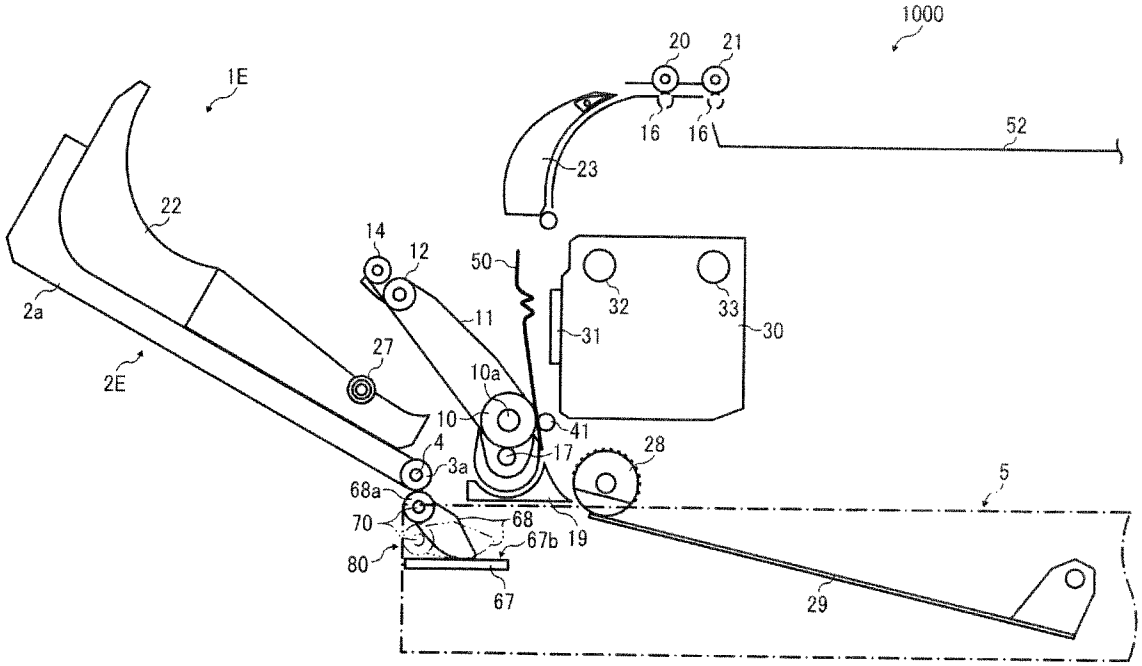
FIG. 30 is a front view of the inkjet recording apparatus of FIG. 29 in a state in which a cover member is placed at an open position.

By contrast, in a case in which the charging roller 17 is disposed at the lower side of the conveyance belt 11, as illustrated in FIGS. 29 and 30, the charging is performed immediately before printing (image formation) and a cover is disposed at the lower side of the conveyance belt 11 to prevent a user from accidentally contacting the charging roller 17. However, such a configuration might increase the number of components.

Additionally, to perform maintenance on the charging roller 17, the cover portion 2*a* of the opening and closing mechanism 1E is configured to be opened to a position at which the charging roller 17 can be removed. Such a configuration can enhance ease of maintenance on the charging roller 17 which is likely to be contaminated with ink. However, to achieve such a configuration, as illustrated in FIG. 30, the sheet conveyance path is preferably exposed to the outside up to a lower side of the duplex conveyance path. As a result, the fulcrum of the cover portion 2*a* is preferably disposed lower than the charging roller 17. In such a configuration, opening the cover portion 2*a* can prevent an outer guide member forming the duplex conveyance path relative to the sheet from interfering with an inner guide member forming the duplex conveyance path. However, in the case in which the fulcrum (the pivot shafts 4) of the cover portion 2*a* is disposed lower than the charging roller 17, when the cover portion 2*a* is opened, the cover portion 2*a* might contact the sheet feed tray 5 withdrawn from the mount position.

To deal with such concerns, in this exemplary embodiment, the hop-up mechanisms 80 illustrated in FIGS. 29 and 30 are employed to move the fulcrum of the cover portion 2*a* upward in synchronization with the pivoting operation of the cover portion 2*a* for opening. Such a configuration can also minimize a clearance at an interface between the upper face of the sheet feed tray 5 and the recessed portion 2*b* (see FIG. 19) of the cover portion 2*a*, thus improving the appearance of the opening and closing mechanism 1E.

Thus, the above-described configuration allows a user to perform front-side operation (removal of a jammed sheet or replacement of components from the front side of the apparatus) while minimizing the machine size. Additionally, as described above, the damper mechanism may be disposed at the movable section of the protrusion 3, thus enhancing ease of operation of the cover portion 2*a*.

As illustrated in FIG. 30, during removal of a jammed sheet, the conveyance belt 11 can pivot around the rotation shaft 10*a* of the conveyance roller 10 and held at a position illustrated in FIG. 30. Such a configuration is advantageous in at least the following two points.

First, fixing the rotation shaft 10*a* of the conveyance roller 10 obviates adjustment of the reference position of an image to be printed, thus enhancing printing precision. Second, by shifting the fulcrum (pivot shafts 4) of the cover portion 2*a*, more space can be obtained to remove a sheet jam occurring when the sheet having an image printed on the front face is conveyed with the conveyance belt 11 at the second side opposite the first side facing the recording heads 31.

Tenth Exemplary Embodiment

A tenth exemplary embodiment according to the present disclosure is described with reference to FIG. 31.

Figure 31:
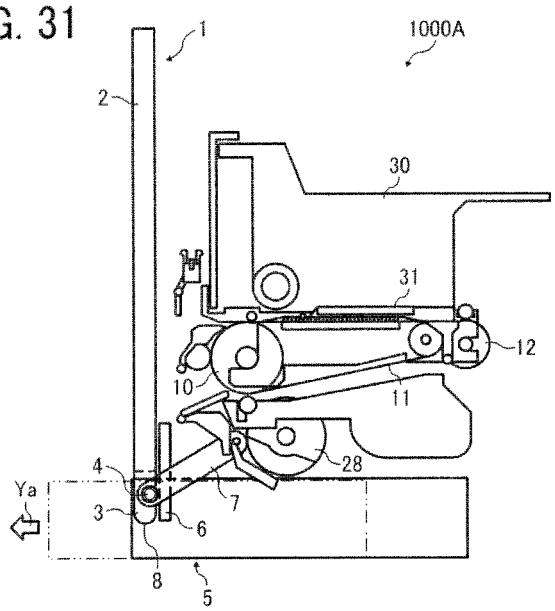
FIG. 31 is a front view of an inkjet recording apparatus of a vertical ejection type illustrated as an example of an image forming apparatus according to a tenth exemplary embodiment.

FIG. 31 is a partial front view of an inkjet printer 1000A illustrated as an example of an image forming apparatus according to the tenth exemplary embodiment.

The inkjet printer 1000A illustrated in FIG. 31 differs from the inkjet printer 1000 illustrated in FIGS. 29 and 30 and is a serial-type inkjet printer employing a vertical ejection method and including the opening and closing mechanism 1 according to the first exemplary embodiment of the present disclosure. The opening and closing mechanism according to any of the exemplary embodiments can be used as, for example, a conveyance path cover (11*a* or 11*b* in FIG. 11) of a vertical-ejection-type inkjet printer (image forming apparatus) described in JP-2005-111979-A. Not only the opening and closing mechanism 1 according to the first exemplary embodiment but also the opening and closing mechanism 1E according to the sixth exemplary embodiment or an opening and closing mechanism according to any of the above-described other exemplary embodiments may be employed in such a vertical-ejection-type inkjet printer. The vertical-ejection-type inkjet printer including an opening and closing mechanism according to any of the above-described exemplary embodiments can obtain the above-described advantages and effects.

Eleventh Exemplary Embodiment

An eleventh exemplary embodiment according to the present disclosure is described with reference to FIG. 32.

Figure 32:
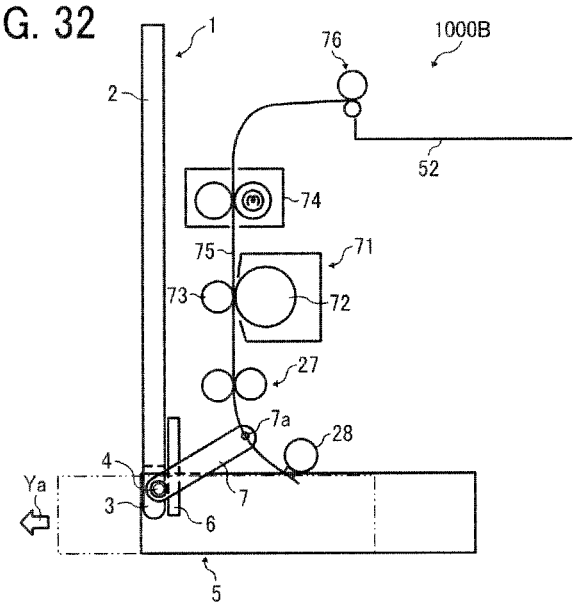
FIG. 32 is a front view of a laser printer illustrated as an example of an image forming apparatus according to an eleventh exemplary embodiment.

FIG. 32 is a partial front view of a laser printer 1000B (electrophotographic image forming apparatus) as an example of an image forming apparatus according to the eleventh exemplary embodiment.

The laser printer 1000B illustrated in FIG. 32 has an image forming device 71, a transfer roller 73, a fixing device 74, a sheet output section, and a sheet feed section. The image forming device 71 includes a photoconductor 72 serving as an image bearing member to bear a latent image thereon and a developing device to supply developer containing toner to the photoconductor 72 to develop the latent image with the toner. The transfer roller 73 is disposed facing the photoconductor 72 and serves as a transfer device to transfer the developed toner image from the photoconductor 72 onto a sheet. The fixing device 74 applies heat and pressure to the sheet to fix the toner image on the sheet. The sheet output section includes a sheet output tray 52 and a pair of outputs rollers 76 to output the sheet having the image fixed to the sheet output tray 52. The sheet feed section includes registration rollers 27 to feed a sheet at such a timing that the latent image on the photoconductor 72 is transferred onto the sheet and a sheet feed roller 28 to feed a sheet from a sheet feed tray 5 toward the sheet feed roller 28.

The laser printer 1000B also includes a vertical conveyance path 75. When the sheet is fed from the sheet feed section to a predetermined position facing the image forming device 71, the image forming device 71 and the transfer roller 73 perform charging, exposure, transfer, and cleaning processes to form a toner image on the sheet. When the sheet is conveyed to the fixing device 74 via the vertical conveyance path 75, the fixing device 74 fixes the toner image on the sheet. The pair of output rollers 76 outputs the sheet having the image fixed thereon to the sheet output tray 52.

In FIG. 32, the laser printer 1000B has the opening and closing mechanism 1 according to the first exemplary embodiment. The opening and closing mechanism used in the laser printer is not only to the opening and closing mechanism 1 according to the first exemplary embodiment. The opening and closing mechanism 1E according to the sixth exemplary embodiment or an opening and closing mechanism according to any of the above-described other exemplary embodiments may be employed in the laser printer. The laser printer including an opening and closing mechanism according to any of the above-described exemplary embodiments can obtain the above-described advantages and effects. The opening and closing mechanism according to any of the exemplary embodiments can be used at, for example, a mount position of a front cover (3 in FIG. 1) of an electrophotographic image forming apparatus described in JP-2003-345220-A. The electrophotographic image forming apparatus is an image formation apparatus allowing the front-side operation, and the front cover (3 illustrated in FIG. 1) is located adjacent to an upper face of a topmost one of multiple-stage sheet feed trays.

In any of the above-described exemplary embodiments, the movable member is disposed at a lower portion of the apparatus main body in the vertical direction, and the cover member (the opening and closing member) is disposed above and adjacent to the movable member. It is to be noted that the arrangement of the movable member and the cover member is not limited to such arrangement, and for example, by contrast, the positions of the cover member and the movable member are arranged upside down. Alternatively, the pivot shaft of the cover member may be arranged along the vertical direction in the opening and closing mechanism and the image forming apparatus including the opening and closing mechanism.

As described above, although specific exemplary embodiments are described in this disclosure, such description is not intended to limit the scope of the invention. For example, some of the components or elements described in the exemplary embodiments of this disclosure may be combined as needed. It is therefore to be understood that, in the scope of the invention, other embodiments and variations are possible according to needs and purposes.

For example, the image forming apparatus is not limited to the inkjet printer described in any of the above-described exemplary embodiments but may be, for example, other inkjet-type image forming apparatus, such as a printer, a plotter, a word processor, a facsimile machine, a copier, a mimeograph apparatus, or a multi-functional device having several of the foregoing capabilities. Also, the image forming apparatus is not limited to a serial-type inkjet printer but may be, for example, a line-type inkjet recording apparatus. The recording medium or sheet is not limited to the sheet 50 but may be any of recording media or sheets, such as a thin paper, a thick paper, a postcard, an envelope, and an overhead projector (OHP) sheet, on which an image can be formed.

What is claimed is:

1. An opening and closing mechanism comprising:

a movable member removably mounted relative to a main body of an apparatus;

an opening and closing member having a cover portion, protrusions, and pivot shafts, the cover portion pivotable between a closed position and an open position around the pivot shafts, the cover portion configured to cover an interior of the main body at the closed position and open the interior of the main body to an outside of the main body at the open position, the protrusions protruding outward from positions of the cover portion adjacent to the pivot shafts; and shaft position adjusters to change positions of the pivot shafts while the cover portion pivots between the closed position and the open position, wherein the opening and closing member is arranged relative to the main body so that, on an imaginary plane perpendicular to a central axis of each of the pivot shafts, a projected portion of each of the pivot shafts on the imaginary plane is positioned to interfere with a projected portion of the movable member on the imaginary plane when the cover portion is placed at the closed position, and the cover portion is positioned so as not to interfere with a trajectory of movement of the movable member relative to the main body while the cover portion pivots toward the open position, and wherein each of the shaft position adjusters includes a guide member to guide a corresponding one of the protrusions or the cover portion and a connecting member having a first end portion pivotably connected to a corresponding one of the pivot shafts and a second end portion pivotably connected to the main body via a shaft.

2. The opening and closing mechanism according to claim 1, wherein, over an entire range of a trajectory of the cover portion pivoting around the pivot shafts, each of the protrusions is positioned more inward of the main body than an outer face of the main body of which the cover portion forms part.

3. The opening and closing mechanism according to claim 1, wherein each of the protrusions has a guided portion guided by the guide member.

4. The opening and closing mechanism according to claim 1, wherein each of the protrusions has a plurality of guided portions guided in turn by the guide member with pivoting movement of the cover portion.

5. The opening and closing mechanism according to claim 1, wherein the guide member includes a plurality of guide portions to guide in turn at least one guided portion of each of the protrusions with pivoting movement of the cover portion.

6. The opening and closing mechanism according to claim 1, wherein, when the cover portion is placed at the closed position, a guided portion of the corresponding one of the protrusions or the cover portion guided by the guide member is placed inward of the main body so as to overlap the movable member in a longer distance than the pivot shaft.

7. The opening and closing mechanism according to claim 1, further comprising a regulation guide member disposed at the main body to prevent the cover portion from accidentally moving upward when the cover portion is placed at the closed position.

8. An image forming apparatus comprising:

a main body:

an image forming device disposed in the main body to form an image on a recording medium; and the opening and closing mechanism according to claim 1 mounted to the main body.

9. An opening and closing mechanism comprising:

a movable member removably mounted relative to a main body of an apparatus;

an opening and closing member having a cover portion, protrusions, and pivot shafts, the cover portion pivotable between a closed position and an open position around the pivot shafts the cover portion configured to cover an interior of the main body at the closed position and open the interior of the main body to an outside of the main body at the open position, the protrusions protruding outward from positions of the cover portion adjacent to the pivot shafts; and shaft position adjusters to change positions of the pivot shafts while the cover portion pivots between the closed position and the open position, wherein the opening and closing member is arranged relative to the main body so that, on an imaginary plane perpendicular to a central axis of each of the pivot shafts, a projected portion of each of the pivot shafts on the imaginary plane is positioned to interfere with a projected portion of the movable member on the imaginary plane when the cover portion is placed at the closed position, and the cover portion is positioned so as not to interfere with a trajectory of movement of the movable member relative to the main body while the cover portion pivots toward the open position, and wherein each of the shaft position adjusters includes a rack fixed at the main body at a position adjacent to a corresponding one of the protrusions and having teeth along a direction to change a position of a corresponding one of the pivot shafts and a pinion unrotatably fixed at the corresponding one of the protrusions to engage the rack.

10. An opening and closing mechanism comprising:

movable means removably mounted relative to an main body of an apparatus;

opening and closing means for opening an interior of the main body relative to an outside of the main body at an open position and closing the interior of the main body relative to the outside of the main body at a closed position, the opening and closing means having cover means for covering the interior of the main body and pivoting means for pivoting the cover means; and position adjustment means for changing positions of the pivoting means while the cover means pivots between the closed position and the open position so that, on an imaginary plane perpendicular to a central axis of each of the pivoting means on which each of the pivoting means and the movable means arc projected, a projected portion of each of the pivoting means interferes with a projected portion of the movable means when the cover means is placed at the closed position, and the cover means does not interfere with a trajectory of movement of the movable means while the cover means pivots toward the open position.

11. The opening and closing mechanism according to claim 10, further comprising guide means for guiding the cover means and connecting means for connecting a corresponding one of the pivoting means and the main body.

12. The opening and closing mechanism according to claim 11, further comprising guided means for being guided by the guide means.

13. The opening and closing mechanism according to claim 10, further comprising cam means for applying force in a direction to change a position of the pivoting means, guide means for guiding the cam means, and slide holding means for holding the pivoting means while sliding the pivoting means in the direction to change the position of the pivoting means.

14. The opening and closing mechanism according to claim 10, further comprising cam means for transmitting a driving force to convert a pivoting movement of the cover means to a movement in a direction to change a position of the pivoting means, slide support means for rotatably supporting the cam, cam holding means for collectively holding the cam means and the pivoting means via the slide support means, guide means for changing the position of the slide support means, and slide holding means for holding the cam holding means slidably in the direction to change the position of the pivoting means.

15. The opening and closing mechanism according to claim 10, further comprising regulation means disposed at the main body for preventing the cover means from accidentally moving upward when the cover means is placed at the closed position.

16. An image forming apparatus comprising:

a main body:

image forming means for forming an image on a recording medium in the main body; and the opening and closing mechanism according to claim 10.

17. An opening and closing mechanism comprising:

a movable member removably mounted relative to a main body of an apparatus;

an opening and closing member having a cover portion, protrusions, and pivot shafts, the cover portion pivotable between a closed position and an open position around the pivot shafts, the cover portion configured to cover an interior of the main body at the closed position and open the interior of the main body to an outside of the main body at the open position, the protrusions protruding outward from positions of the cover portion adjacent to the pivot shafts; and shaft position adjusters to change positions of the pivot shafts while the cover portion pivots between the closed position and the open position, wherein the opening and closing member is arranged relative to the main body so that the cover portion is positioned so as not to interfere with a trajectory of movement of the movable member relative to the main body while the cover portion pivots toward the open position, and wherein each of the shaft position adjusters includes a guide member to guide a corresponding one of the protrusions or the cover portion and a connecting member having a first end portion pivotably connected to a corresponding one of the pivot shafts and a second end portion pivotably connected to the main body via a shaft.

* * * * *